US010203654B2

(12) United States Patent
Satomura et al.

(10) Patent No.: US 10,203,654 B2
(45) Date of Patent: Feb. 12, 2019

(54) CARTRIDGE AND METHOD FOR MANUFACTURING CARTRIDGE

(71) Applicant: CANON KABUSHIKI KAISHA, Tokyo (JP)

(72) Inventors: Shogo Satomura, Kawasaki (JP); Fumito Nonaka, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/838,102

(22) Filed: Aug. 27, 2015

(65) Prior Publication Data

US 2016/0062310 A1 Mar. 3, 2016

(30) Foreign Application Priority Data

Aug. 29, 2014 (JP) ..... 2014-176313
Aug. 29, 2014 (JP) ..... 2014-176314

(51) Int. Cl.
*G03G 15/08* (2006.01)
*G03G 21/18* (2006.01)

(52) U.S. Cl.
CPC ..... *G03G 21/1814* (2013.01); *G03G 21/1832* (2013.01)

(58) Field of Classification Search
CPC ..... G03G 2221/1648; G03G 15/0817; G03G 15/0898
USPC ..... 399/102, 103, 105
See application file for complete search history.

(56) References Cited

U.S. PATENT DOCUMENTS 5,502,547 A * 3/1996 Shirai ..... G03G 15/0817 399/102
8,244,156 B2 * 8/2012 Iwamoto ..... G03G 15/0817
2013/0121720 A1 5/2013 Hoshi
2013/0129378 A1 * 5/2013 Hoshi ..... G03G 15/0898
2014/0093270 A1 4/2014 Nonaka

FOREIGN PATENT DOCUMENTS

JP H11-272071 A 10/1999
JP 2001092204 A 4/2001
JP 2001-125465 A 5/2001
JP 2013122489 A 6/2013
JP 2014071428 A 4/2014

* cited by examiner

*Primary Examiner* — Benjamin Schmitt
*Assistant Examiner* — Milton Gonzalez
(74) *Attorney, Agent, or Firm* — Canon U.S.A. Inc., IP Division

(57) ABSTRACT

A cartridge includes a cartridge frame member including a developer accommodation portion, an image bearing member rotatably provided to the cartridge frame member, an end sealing provided to the cartridge frame member and abutting on an end of the image bearing member in a longitudinal direction, a cleaning unit for acting on the image bearing member, a sealing portion integrally provided with the cartridge frame member and abut on an end of the cleaning unit in the longitudinal direction, a sheet member provided along the longitudinal direction and abut on the image bearing member at an end of the sheet member in a direction that crosses the longitudinal direction, and a fixing portion for fixing the sheet member and the cartridge frame member. The sealing portion and the fixing portion are integrally formed with the cartridge frame member.

12 Claims, 28 Drawing Sheets

CARTRIDGE AND METHOD FOR MANUFACTURING CARTRIDGE

BACKGROUND OF THE INVENTION

Field of the Invention

The present invention relates to a cartridge detachable to an image forming apparatus for forming an image on a recording medium and a method for manufacturing the same.

Description of the Related Art

The present invention relates to an electrophotographic image forming apparatus and a process cartridge (hereinafter referred to as a cartridge) detachable to the electrophotographic image forming apparatus. The electrophotographic image forming apparatus (hereinafter referred to as an image forming apparatus) forms an image on a recording material (recording medium) using an electrophotographic image forming process. An example of the image forming apparatus includes a printer (laser beam printer, light emitting diode (LED) printer, etc.), a copying machine, a facsimile apparatus, a word processor, and a multifunction machine thereof (multifunction printer).

In the image forming apparatus using the electrophotographic image forming process, a process cartridge system is conventionally adopted that allows the cartridge to be detachable to an apparatus main body of the image forming apparatus. The process cartridge system simplifies maintenance of the image forming apparatus by integrating the electrophotographic photosensitive drum (hereinafter referred to as a photosensitive drum) and a process unit acting on the photosensitive drum into the cartridge.

In such a cartridge, cartridge frame members and components constituting the cartridge are sealed therebetween by a plurality of sealing members so that developer (toner) accommodated in the cartridge does not leak out.

In a technique discussed in Japanese Patent Application Laid-Open No. 11-272071, an elastic member, such as an urethane foam, a soft rubber, an elastomer resin, and the like, is used as a sealing member. The sealing member is accurately attached to a coupling portion between frame members and components. However, Japanese Patent Application Laid-Open No. 2001-125465 discusses, for a gap occurring due to the dimensional tolerance of components or variation in the attaching position, a method in which a molten resin, such as a hot melt, is poured into the gap in such a manner that the gap is filled with the resin whereby higher sealing performance is obtained.

In recent years, a method for manufacturing the cartridge has been shifted from a manual method to an automatic (robot) method for the purpose of cost down which is led by increased production efficiency and stability in quality during assembly.

SUMMARY OF THE INVENTION

According to an aspect of the present invention, a cartridge detachable to an image forming apparatus main body, the cartridge includes a cartridge frame member including a developer accommodation portion, an image bearing member configured to be rotatably provided to the cartridge frame member, an end sealing configured to be provided to the cartridge frame member and abut on an end of the image bearing member in a longitudinal direction, a cleaning unit configured to act on the image bearing member, a sealing portion configured to be integrally provided with the cartridge frame member and abut on an end of the cleaning unit in the longitudinal direction, a sheet member configure to be provided along the longitudinal direction and abut on the image bearing member at an end of the sheet member in a direction that crosses the longitudinal direction, and a fixing portion configured to fix the sheet member and the cartridge frame member, wherein the sealing portion and the fixing portion are integrally formed with the cartridge frame member.

According to another aspect of the present invention, a method for manufacturing a cartridge detachable to an image forming apparatus main body, the cartridge including a cartridge frame member including a developer accommodation portion, an image bearing member configured to be rotatably provided to the cartridge frame member, an end sealing configured to be provided to the cartridge frame member and abut on an end of the image bearing member in a longitudinal direction, a cleaning unit configured to act on the image bearing member, a sealing portion configured to be integrally provided with the cartridge frame member and abut on an end of the cleaning unit in the longitudinal direction, a sheet member configured to be provided along the longitudinal direction and abut on the image bearing member at an end of the sheet member in a direction that crosses the longitudinal direction, and a fixing portion configured to fix the sheet member and the cartridge frame member, the method includes integrally molding, as a first process, the sealing portion and the fixing portion with the cartridge frame member by injecting a molten resin, fixing, as a second process, the end sealing and the cleaning unit on the cartridge frame member, disposing, as a third process, the sheet member on the fixing portion, welding the resin member, and fixing the sheet member to the cartridge frame member, and fixing, as a fourth process, the image bearing member to the cartridge frame member.

Further features of the present invention will become apparent from the following description of exemplary embodiments with reference to the attached drawings.

DESCRIPTION OF THE EMBODIMENTS

An image forming apparatus and a cartridge according to a first exemplary embodiment of the present invention is described below in detail with reference to drawings. In description below, a longitudinal direction N of the cartridge is a rotational axis direction of a photosensitive drum that is an image bearing member.

(Entire Configuration)

Figure 1:
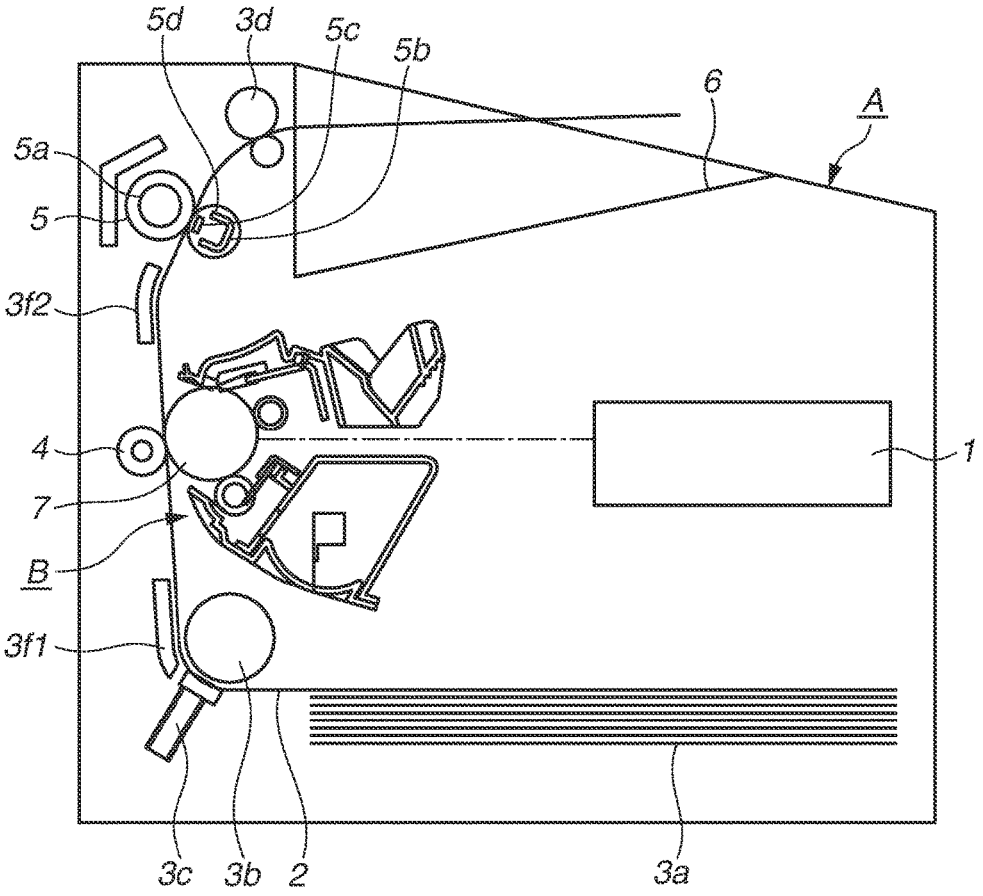
FIG. 1 is a schematic cross sectional view illustrating an image forming apparatus according to an exemplary embodiment.
Figure 2:
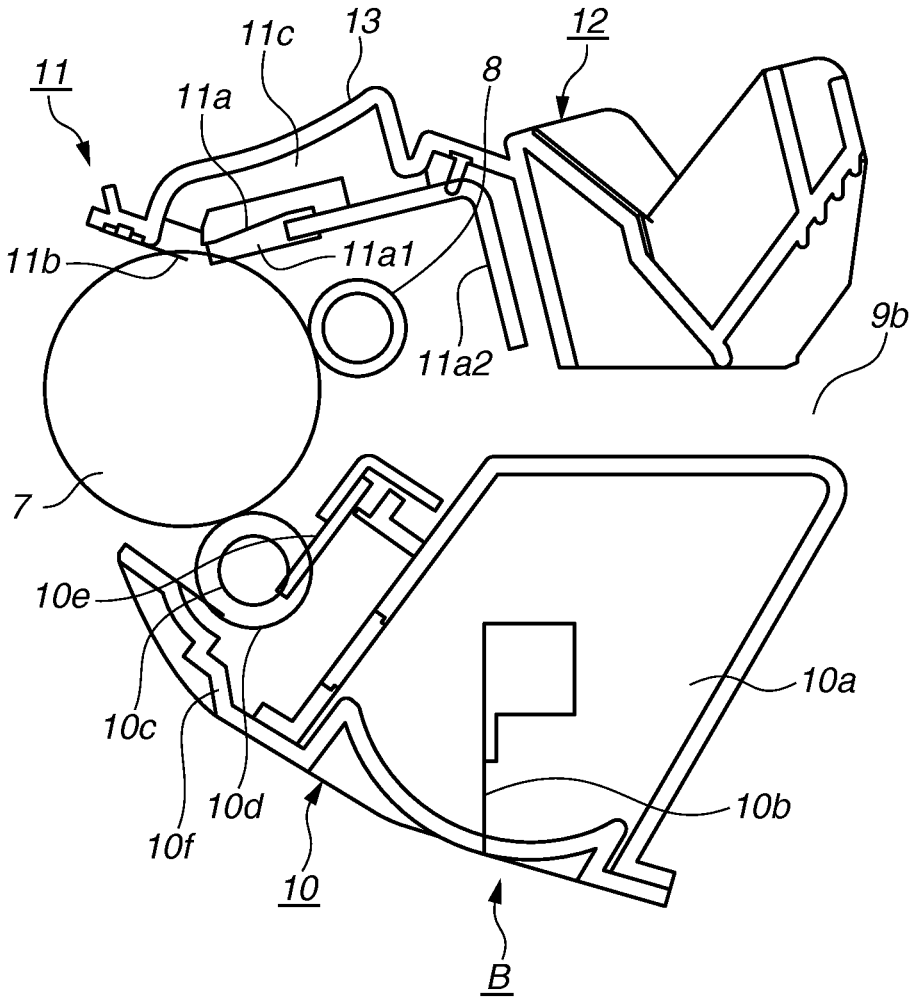
FIG. 2 is a schematic cross sectional view illustrating a process cartridge according to an exemplary embodiment.

An entire configuration of an image forming apparatus main body and a process cartridge detachable to the image forming apparatus main body is outlined with reference to FIGS. 1 and 2. FIG. 1 is a schematic cross sectional view illustrating an entire configuration of a laser beam printer that is one form of an electrophotographic image forming apparatus main body according to the present exemplary embodiment, and FIG. 2 is a schematic cross sectional view illustrating a process cartridge according to the present exemplary embodiment.

In an image forming apparatus main body A, as illustrated in FIG. 1, information light (light image) based on image information is radiated from an exposure apparatus 1 to a photosensitive drum 7 (image bearing member) that is a drum-shaped electrophotographic photosensitive member. As a result, an electrostatic latent image is formed on the photosensitive drum 7, and the electrostatic latent image is developed with a toner (developer) so that a toner image is formed. Then, in synchronization with forming of the toner image, a recording medium 2, such as a recording sheet, an overhead projector (OHP) sheet, or a cloth is separated and fed one by one by a pickup roller 3*b* and a pressure contact member 3*c* being in pressure contact with the pickup roller 3*b* from a paper feeding unit 3*a* (cassette). The toner image formed on the photosensitive drum 7 of a process cartridge B is transferred to the recording medium 2 conveyed along a conveyance guide 3*f*1, by application of a voltage to a transferring roller 4 as a transferring unit. Further, the recording medium 2 to which the toner image is transferred is conveyed along a conveyance guide 3*f*2 to a fixing unit 5. The fixing unit 5 includes a fixing rotary member 5*d* configured by a driving roller 5*a* and a cylindrical sheet, a support member 5*c* for rotatably supporting the fixing rotary member 5*d*, and a heater 5*b* disposed inside the fixing rotary member 5*d*. The fixing rotary member 5*d* heated by the heater 5*b* is driven to rotate relative to the driving roller 5*a*, and applies heat and pressure to the recording medium 2 passing therethrough to fix the transferred toner image. The recording medium 2 to which the transferred toner image is fixed is conveyed by a discharging roller 3*d*, and discharged through a reversal conveyance path to a discharge portion 6. In the present exemplary embodiment, a conveyance unit 3 is configured by the pickup roller 3*b*, the pressure contact member 3*c*, and the discharging roller 3*d*. However, the configuration is not limited to the above.

(Cartridge Configuration)

The cartridge B, as illustrated in FIG. 2, includes the photosensitive drum 7 and at least one process unit. Examples of the process unit includes a charging unit for charging the photosensitive drum 7, a development unit for developing the electrostatic latent image formed on the photosensitive drum 7, and a cleaning unit for cleaning a toner remaining on the photosensitive drum 7. In the cartridge B according to the present exemplary embodiment, the photosensitive drum 7 that is the electrophotographic photosensitive member including a photosensitive layer is driven to rotate, and a voltage is applied to a charging roller 8 that is the charging unit to uniformly charge a surface of the photosensitive drum 7. The photosensitive drum 7 in a charged state is exposed by the information light based on the image information from the exposure apparatus 1 through an exposure opening 9*b*, and the electrostatic latent image is formed on the surface of the photosensitive drum 7, and then the electrostatic latent image is developed by the development unit.

In the development unit, the toner accommodated inside a toner accommodation portion 10*a* that is a developer accommodation portion included in a development frame member 10*f* is fed by a rotatable feeding member 10*b* that is a toner feeding unit. Then, a development roller 10*d* that is a developer bearing member (development rotary member) provided with a stationary magnet 10*c* therein is rotated. Then, a toner layer is formed on the surface of the development roller 10*d* with the toner charged by friction with a development blade 10*e*, and the toner image is formed by transferring the toner to the photosensitive drum 7 according to the electrostatic latent image so that an image is visualized.

Then, a voltage of a reverse polarity to the toner image is applied to the transferring roller 4 to transfer the toner image to the recording medium 2. After the toner image is transferred, a cleaning blade 11*a* that is the cleaning unit is applied to the photosensitive drum 7 to scrape the remaining toner from the photosensitive drum 7, and a scooping sheet 11*b* prevents the remaining toner from leaking to the outside of a waste toner storage portion 11*c*.

The cartridge B is divided into a photosensitive drum unit 11 and a development unit 10. The photosensitive drum unit 11 includes the photosensitive drum 7, the charging roller 8 that is the charging unit, the cleaning blade 11*a* that is the cleaning unit, the scooping sheet 11*b*, and a cleaning subunit 12. The cleaning blade 11*a* includes a rubber portion 11*a*1 abutting on the photosensitive drum 7 and a metal plate portion 11*a*2 for supporting the rubber portion 11*a*1. The development unit 10 includes the toner accommodation portion 10*a* constituting the development frame member 10*f* and development unit, and a development container. The development unit includes the development roller 10*d* and the development blade 10*e*.

(Sealing Configuration of Cleaning Subunit)

Figure 3:
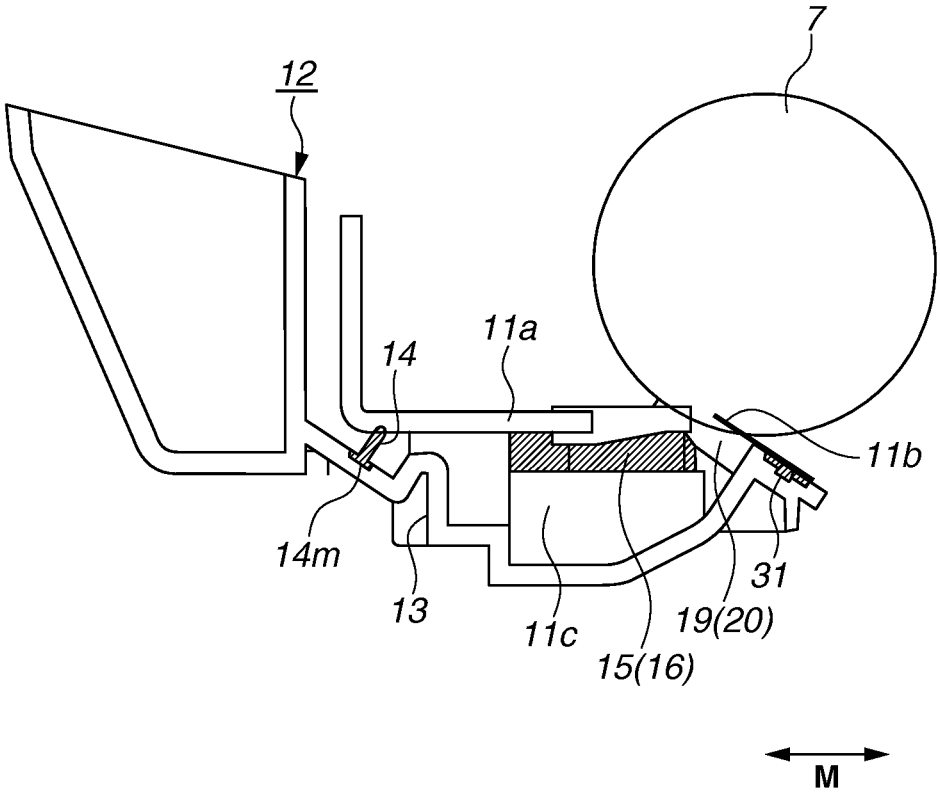
FIG. 3 is a schematic cross sectional view illustrating a photosensitive drum unit according to a first exemplary embodiment.
Figure 4:
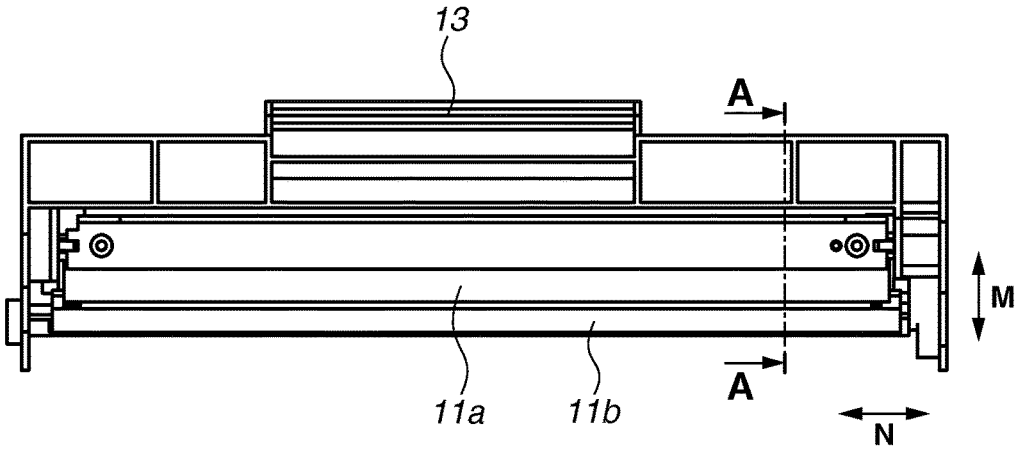
FIG. 4 is a schematic front view illustrating a cleaning subunit to which a scooping sheet and a cleaning blade are attached according to the first exemplary embodiment.
Figure 5:
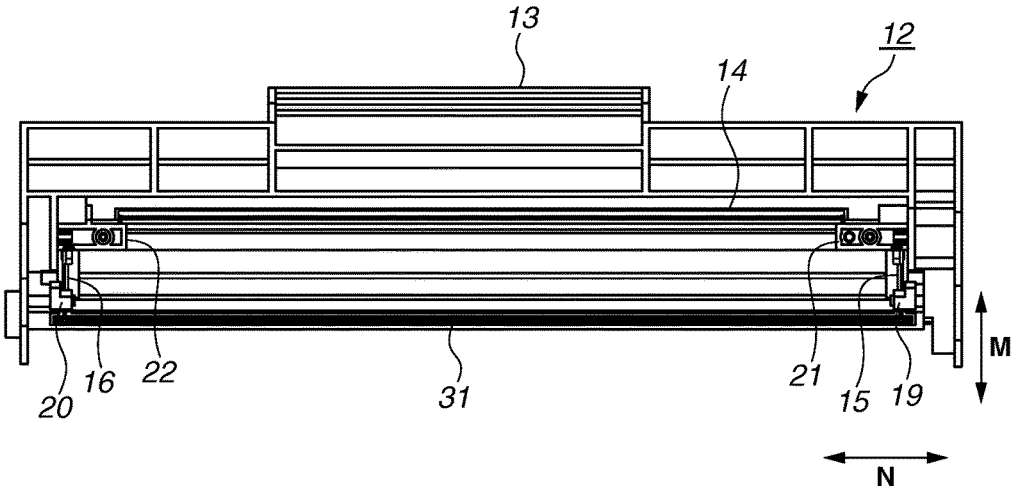
FIG. 5 is a schematic front view illustrating the cleaning subunit according to the first exemplary embodiment.
Figure 6:
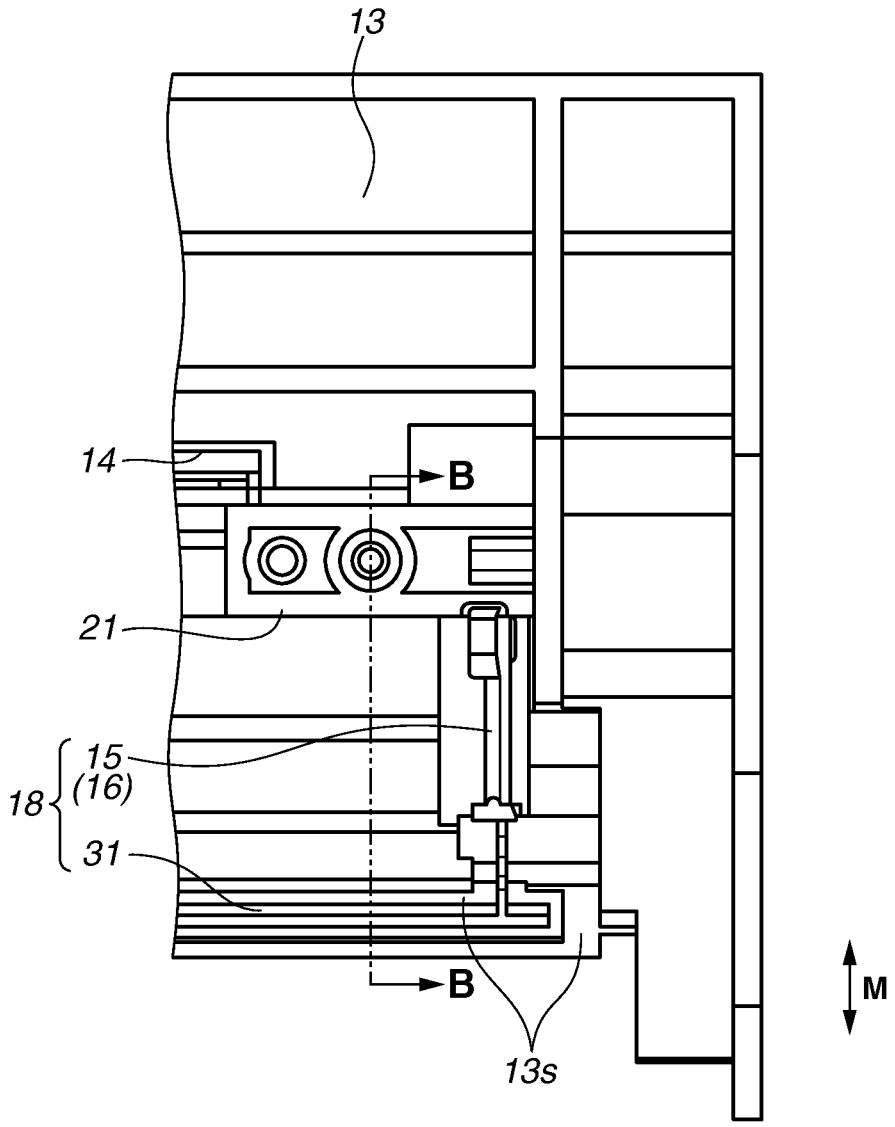
FIG. 6 is a schematic front view illustrating a vicinity of a vertical sealing portion of the cleaning subunit according to the first exemplary embodiment.
Figure 7:
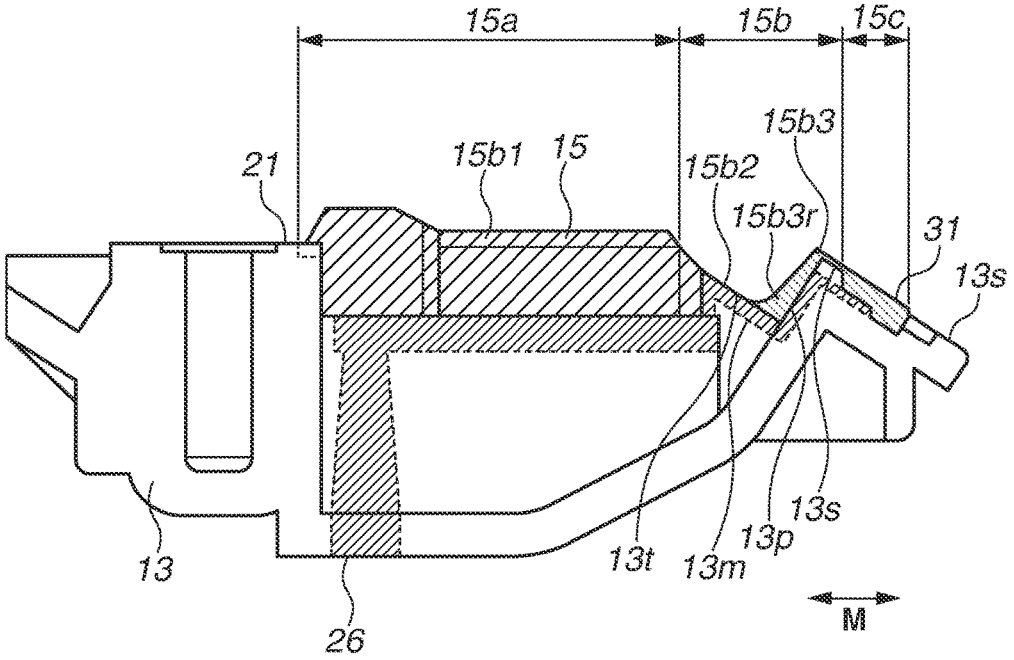
FIG. 7 is a schematic cross sectional view illustrating a vicinity of the vertical sealing portion of the cleaning subunit according to the first exemplary embodiment.
Figure 8A:
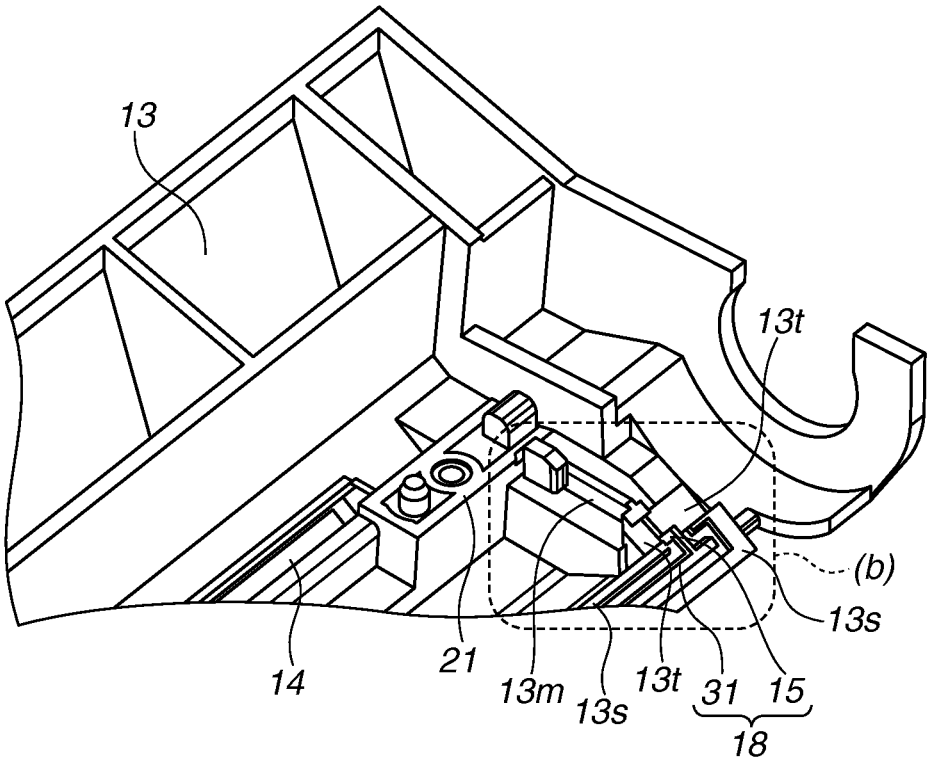
FIGS. 8A and 8B are schematic perspective views each illustrating a vicinity of the vertical sealing portion of the cleaning subunit according to the first exemplary embodiment.
Figure 8B:
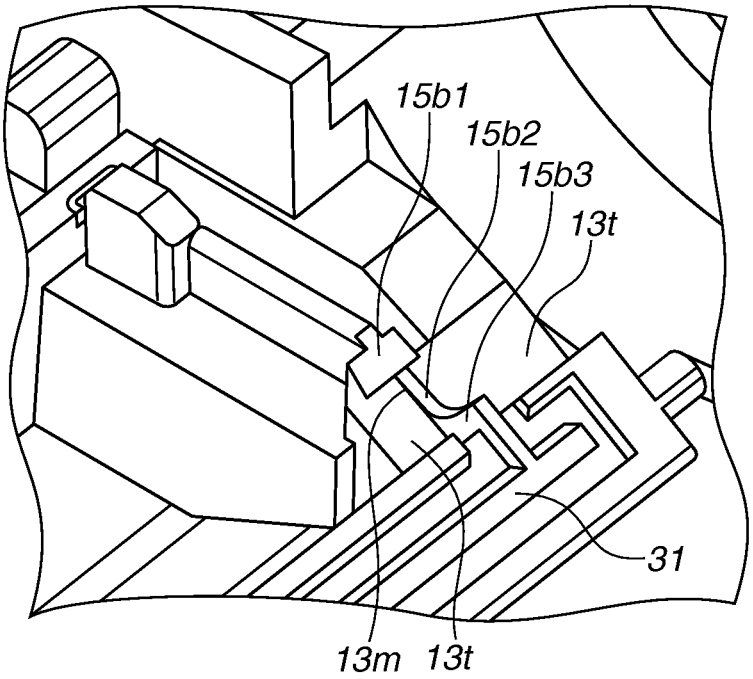

A sealing configuration of the cleaning subunit 12 according to the present exemplary embodiment is described in detail with reference to FIGS. 3 to 11. FIG. 3 is a schematic cross sectional view illustrating the photosensitive drum unit 11 according to the present exemplary embodiment. FIG. 4 is a schematic front view illustrating the cleaning subunit 12 to which the cleaning blade 11*a* and the scooping sheet 11*b* are attached according to the present exemplary embodiment. FIG. 5 is a schematic front view illustrating the cleaning subunit 12 according to the present exemplary embodiment. FIG. 6 is a schematic front view illustrating a vicinity of a vertical sealing portion 15 (16) of the cleaning subunit 12 according to the present exemplary embodiment. FIG. 7 is a cross sectional view illustrating a vicinity of the vertical sealing portion 15 (16) of the cleaning subunit 12 taken along the line B-B illustrated in FIG. 6. FIGS. 8A and 8B are schematic perspective views each illustrating a vicinity of the vertical sealing portion 15 (16) of the cleaning subunit 12 according to the present exemplary embodiment. FIG. 8B is a diagram illustrating a partial detail of FIG. 8A.

As illustrated in FIGS. 3 and 5, the cleaning subunit 12 is provided with a cleaning blade lower sealing 14, end sealings 19 and 20, and a fixing portion 31. Specifically, the cleaning blade lower sealing 14 is provided over attachment surfaces 21 and 22. Each of the attachment surfaces 21 and 22 are provided at both ends of the cleaning frame member 13 (cartridge frame member) in the longitudinal direction N. As illustrated in FIG. 6 to FIGS. 8A and 8B, the vertical sealing portions 15 and 16 and the fixing portion 31 are configured to be a resin member 18 that is integrally molded with the cleaning frame member 13 using the same material. More specifically, the vertical sealing portions 15 and 16 are provided in such a manner that the fixing portion 31 and the vicinity of the attachment surfaces 21 and 22 are connected with each other via the vertical sealing portions 15 and 16 using the same material of the fixing portion 31 for fixing the scooping sheet 11*b*. Thus, a gap between the cleaning blade 11*a* and the cleaning frame member 13 is sealed by the cleaning blade lower sealing 14 and the vertical sealing portions 15 and 16.

Further, the scooping sheet 11*b* abutting on the photosensitive drum 7 to prevent leakage of waste toner is provided to the cleaning frame member 13 via the fixing portion 31 of the resin member 18. According to the present exemplary embodiment, the scooping sheet 11*b* is fixed to the cleaning frame member 13 with the fixing portion 31 of the resin member 18 to which the scooping sheet 11*b* is welded.

Material of the fixing portion 31 may be any type of resin that is injection moldable, that is, for example, an elastomer resin can be used. A similar type of material to the cleaning frame member 13 is desirable as the material of the fixing portion 31, since it is not necessary to separate the fixing portion 31 from the cleaning frame member 13 at the time of recycling of the process cartridge B. Therefore, in the present exemplary embodiment, a styrene-based elastomer resin that is a similar type of material to the cleaning frame member 13 formed of a polystyrene resin is used as the material of the fixing portion 31. Alternatively, a silicone-based rubber or a soft rubber can be used.

Figure 9:
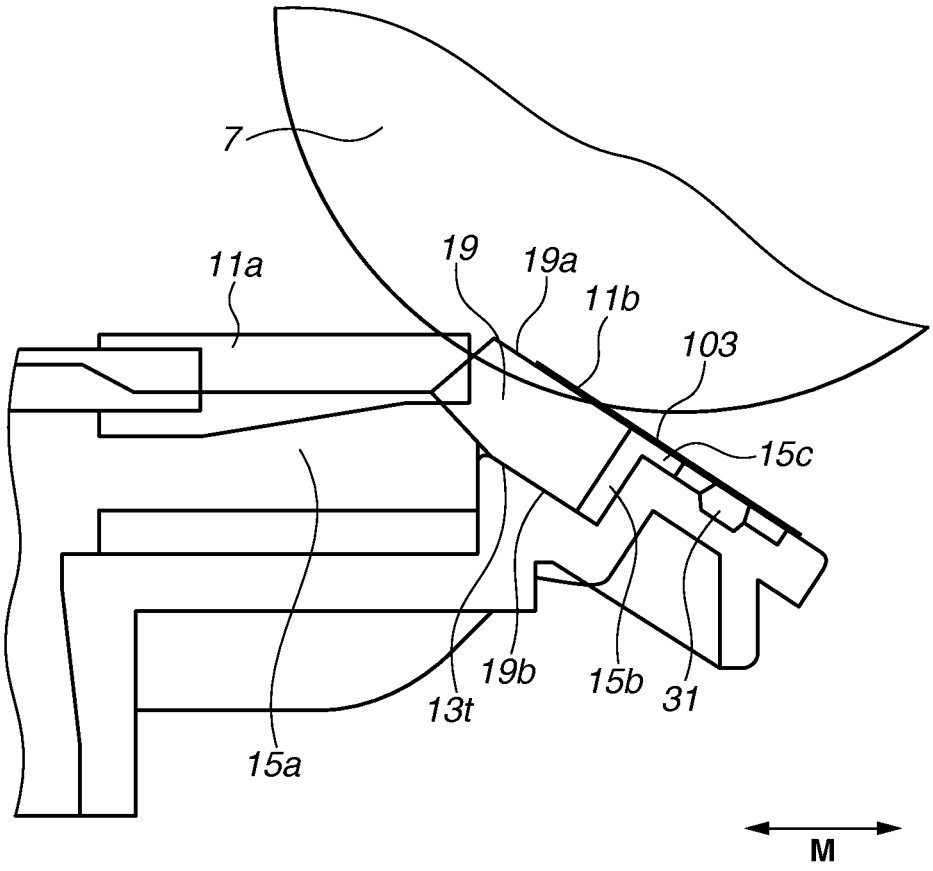
FIG. 9 is a schematic cross sectional view illustrating a vicinity of the vertical sealing portion of the photosensitive drum unit according to the first exemplary embodiment.

As illustrated in FIG. 9, the end sealing 19 (20) includes a surface 19*a* (20*a*) abutting on the photosensitive drum 7, and an adhesive surface 19*b* (20*b*) for adhering to an attaching surface 13*t* of the cleaning frame member 13. Thus, the end sealings 19 and 20 are disposed in such a manner that the end sealings 19 and 20 abut on the photosensitive drum 7, so that the gap between the photosensitive drum 7 and the cleaning frame member 13 is sealed and leakage of a toner to the outside of the cartridge B is prevented. As illustrated in FIGS. 8A and 8B, in order that the end sealings 19 and 20 are attached to the attaching surface 13*t* of the cleaning frame member 13, a groove portion 13*m* is provided to the attaching surface 13*t*, and the vertical sealing portion 15 (16) and the fixing portion 31 are connected together via the groove portion 13*m* so that the configuration is molded in an integral manner. For the end sealing 19 (20), a flexible member, such as felt or non-woven fabric, pile made in such a manner that fibers are woven into fabric, or electrostatic flocking is used for a surface 19*a* (20*a*).

The vertical sealing portions 15 and 16 are described in detail. According to the present exemplary embodiment, the vertical sealing portions 15 and 16 are symmetrically configured relative to the longitudinal direction N of the cleaning frame member 13. Therefore, the vertical sealing portion 15 is taken as an example and described below. As illustrated in FIG. 7, the vertical sealing portion 15 extends in the lateral direction M crossing the longitudinal direction N, and includes three portions that are a first portion 15*a*, a second portion 15*b*, and a third portion 15*c*.

(First Portion 15*a* of Vertical Sealing Portion)

Figure 10A:
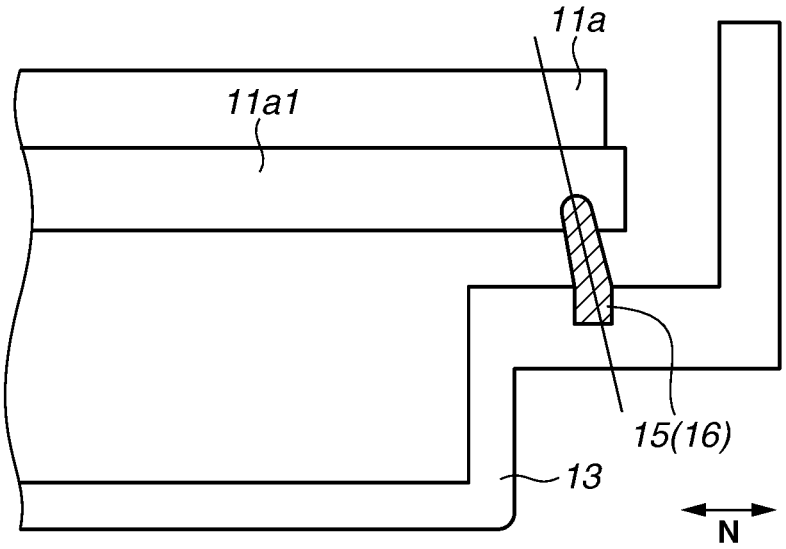
FIGS. 10A and 10B are schematic descriptive views each illustrating a cross sectional shape of the vertical sealing portion according to the first exemplary embodiment.
Figure 10B:
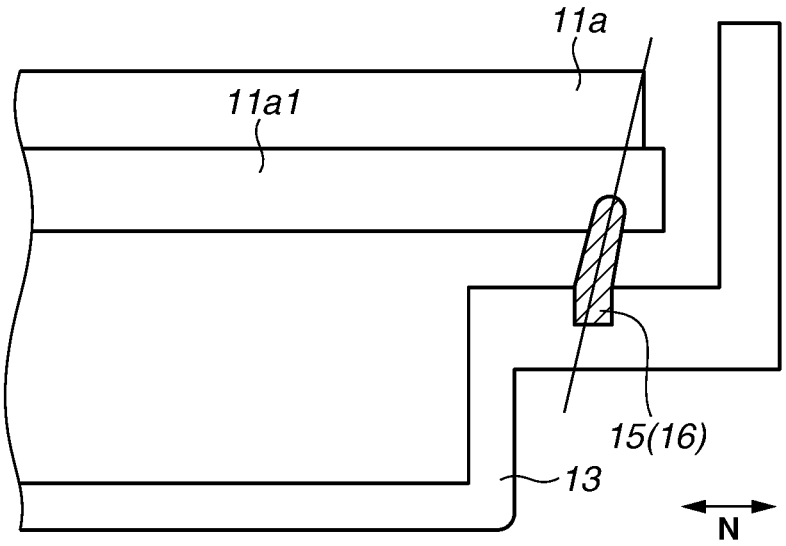

As illustrated in FIG. 7, the first portion 15*a* of the vertical sealing portion 15 is disposed between the cleaning blade 11*a* and the cleaning frame member 13. More specifically, as illustrated in FIG. 10, the first portion 15*a* extends from the cleaning frame member 13 toward the cleaning blade 11*a*, and abuts on the cleaning blade 11*a*. In this case, it is desirable for the first portion 15*a* to be disposed in such a manner that a line, connecting between a contact portion of the vertical sealing portion 15 with the cleaning frame member 13 and a contact portion of the vertical sealing portion 15 with the cleaning blade 11*a*, non-orthogonally crosses the longitudinal direction N. Thus, the vertical sealing portion 15 is disposed to be tilted to the longitudinal direction N, so that the vertical sealing portion 15 is fixed in a state of being deformed in a bent manner between the cleaning blade 11*a* and the cleaning frame member 13. As a result, repulsive force of the cleaning blade 11*a* to the rubber portion 11*a*1 generated by deforming of the vertical sealing portion 15 can be reduced. Therefore, it can be suppressed that abutment pressure to be received by the photosensitive drum 7 from the rubber portion 11*a*1 of the cleaning blade 11*a* is increased at the vicinities of the vertical sealing portions 15 and 16 whereby cleaning of the surface of the photosensitive drum 7 can be uniformly performed and satisfactorily stabilized. Although the first portion 15*a* may have a tilted shape only for a portion abutting on the rubber portion 11*a*1 of the cleaning blade 11*a*, a portion abutting on the metal plate portion 11*a*2 can also be the similar shape. A direction of tilting may be an inside direction (FIG. 10A) of the cleaning frame member 13 in the longitudinal direction N, or an outside direction (FIG. 10B). In the present exemplary embodiment, for shortening a length of the cleaning frame member 13 and the cleaning blade 11*a* in the longitudinal direction N, the shape tilted inside is desirable and adopted. Further, also in terms of the toner sealing, the shape tilted inside of the cleaning frame member 13 is adopted in the longitudinal direction N.

(Second Portion 15*b* of Vertical Sealing Portion)

The second portion 15*b* of the vertical sealing portion 15 is described. As illustrated in FIG. 7, the second portion 15*b* is formed in such a manner that the second portion 15*b* connects to the first portion 15*a* in the longitudinal direction N. As illustrated in FIG. 9, the second portion 15*b* is compressed by the cleaning frame member 13 and the end sealing 19 and disposed in such a manner that the second portion 15*b* seals between the cleaning frame member 13 and the end sealing 19.

More specifically, as illustrated in FIG. 8B, the second portion 15*b* comes in contact with the end sealing 19 at three contact portions (15*b*1, 15*b*2, 15*b*3). The contact portion 15*b*1 forms an inclined surface that smoothly connects the first portion 15*a* to the attaching surface 13*t*. With such a configuration, in a case where the end sealing fails to close a step between the vertical sealing portion 15 and the attaching surface 13*t* when the end sealing 19 is attached to the attaching surface 13*t*, it is prevented that a gap occurs whereby toner leakage is reliably prevented.

The contact portion 15*b*2 connecting with the contact portion 15*b*1 is made to have almost the same height as the attaching surface 13*t* so that an adhesive layer 19*b* and the attaching surface 13*t* are reliably attached together. In order that the contact portion 15*b*2 is made to have almost the same height as the attaching surface 13*t*, the groove portion 13*m* is provided to the attaching surface 13*t* of the cleaning frame member 13, and the contact portion 15*b*2 is provided to the groove portion 13*m*.

The contact portion 15*b*3 smoothly connected from the contact portion 15*b*2, as illustrated in FIG. 7, is disposed to a step portion 13*p* which is a portion where the attaching surface 13*t* is connected to a fixing surface 13*s* to which the scooping sheet 11*b* is attached. The contact portion 15*b*3 is made to be a rib shape protruding from the step portion 13*p* in a direction in which the attaching surface 13*t* extends. In the corner portion 13*r* at which the attaching surface 13*t* crosses the step portion 13*p*, a curved shape 15*b*3*r* is provided so that the contact portions 15*b*2 and 15*b*3 are smoothly connected together. With such a configuration, in a case where the end sealing 19 fails to close the corner portion 13*r* at which the attaching surface 13*t* of the cleaning frame member 13 crosses the step portion 13*p* when the end sealing 19 is attached to the cleaning frame member 13, it is prevented that a gap occurs. As a result, the toner leakage from between the end sealing 19 and the cleaning frame member 13 is reliably prevented. In addition, the contact portion 15*b*3 is made to be a rib shape with a narrow width, and repulsive force, which is generated by the contact portion 15*b*3 compressed by the end sealing 19 and fixed in a state of being deformed, to the end sealing 19 can be reduced. According to the present exemplary embodiment, the width of the contact portion 15*b*3 is about 0.6 mm. As a result, as illustrated in FIG. 9, the contact portion 15*b*3 can be easily compressed and deformed by the end sealing 19, and it is satisfactorily prevented that the gap is generated between the end sealing 19 and the cleaning frame member 13, and the toner leakage is reliably prevented.

(Third Portion 15*c* of Vertical Sealing Portion and Fixing Portion 31)

The third portion 15*c* is described. The third portion 15*c*, as illustrated in FIG. 9, is formed between the scooping sheet 11*b* and the cleaning frame member 13. More specifically, as illustrated in FIG. 8B, one end of the third portion 15*c* is formed in such a manner that the third portion 15*c* is connected with the connection portion 15*b*3 of the second portion 15*b*. The other end of the third portion 15*c* is continuously formed with the fixing portion 31.

According to the present exemplary embodiment, the cleaning frame member 13 formed of a polystyrene resin and the scooping sheet 11*b* of a thin plate member (sheet member) formed of polyester resin are used. Therefore, there is a possibility that the scooping sheet 11*b* is swelled by the difference in thermal expansion due to the difference between the material of the cleaning frame member 13 and the scooping sheet 11*b* when the ambient temperature change occurs. In this case, a gap occurs between the scooping sheet 11*b* and the photosensitive drum 7 on which the scooping sheet 11*b* abuts, and the waste toner may be leaked out.

Thus, in the present exemplary embodiment, the fixing portion 31 molded to the frame member can serve as a buffer for absorbing the difference of the cleaning frame member 13 and the scooping sheet 11*b* in linear expansion in an environment under a high temperature. As a result, the swell of the sheet member after the environment in the high temperature can be prevented.

(Fixing of Scooping Sheet)

A fixing configuration of the scooping sheet 11*b* is described. The scooping sheet 11*b* is fixed to the cleaning frame member 13 via the fixing portion 31 of the resin member 18. More specifically, the scooping sheet 11*b* is fixed to the cleaning frame member 13 in such a manner that the fixing portion 31 of the resin member 18 and a part of the third portion 15*c* are welded together.

(Effect of the Present Exemplary Embodiment)

As described above, according to the present exemplary embodiment, a gap occurring between the scooping sheet fixing surface 13*s* and the scooping sheet 11*b* can be filled by forming the resin member 18 including the vertical sealing portion 15 and the fixing portion 31 by injection molding of the resin. Further, the gap is eliminated in such a manner that the vertical sealing portion 15 and the fixing portion 31 are melted so as to closely contact with the scooping sheet 11*b*, and toner sealability at an end of the cleaning frame member 13 can be increased. Conventionally, the toner leakage occurs from the gap between the cleaning frame member and the end sealing member of the image bearing member (gap in the thickness direction of the end sealing member of the image bearing member) or the gap between the cleaning frame member and the scooping sheet. Therefore, to solve the problem, conventionally, a process for applying another molten resin is further required for sealing and filling these gaps with a molten resin (hot melt). Thus, the productivity is decreased. According to the present exemplary embodiment, however, a hot melt injection process performed for closing the gap between the cleaning frame member 13 and the end sealing 19 is not required, and simplification of a production process can be achieved by the configuration according to the present exemplary embodiment.

In addition, since the sealing member is a soft body component, an automatic machine has difficulty to hold the sealing member. Thus, it becomes difficult to accurately past the sealing member to the cleaning frame member. In particular, in a process for attaching the sealing member, assembly by the automatic machine is difficult, and the productivity cannot be improved. However, by the configuration according to the present exemplary embodiment, the cartridge can be configured with the sealing member for which a soft component is not used. Therefore, the assembly is easy and can be performed by the automatic machine whereby high productivity of the cartridge can be achieved.

(Method for Manufacturing Cleaning Subunit)

Figure 11:
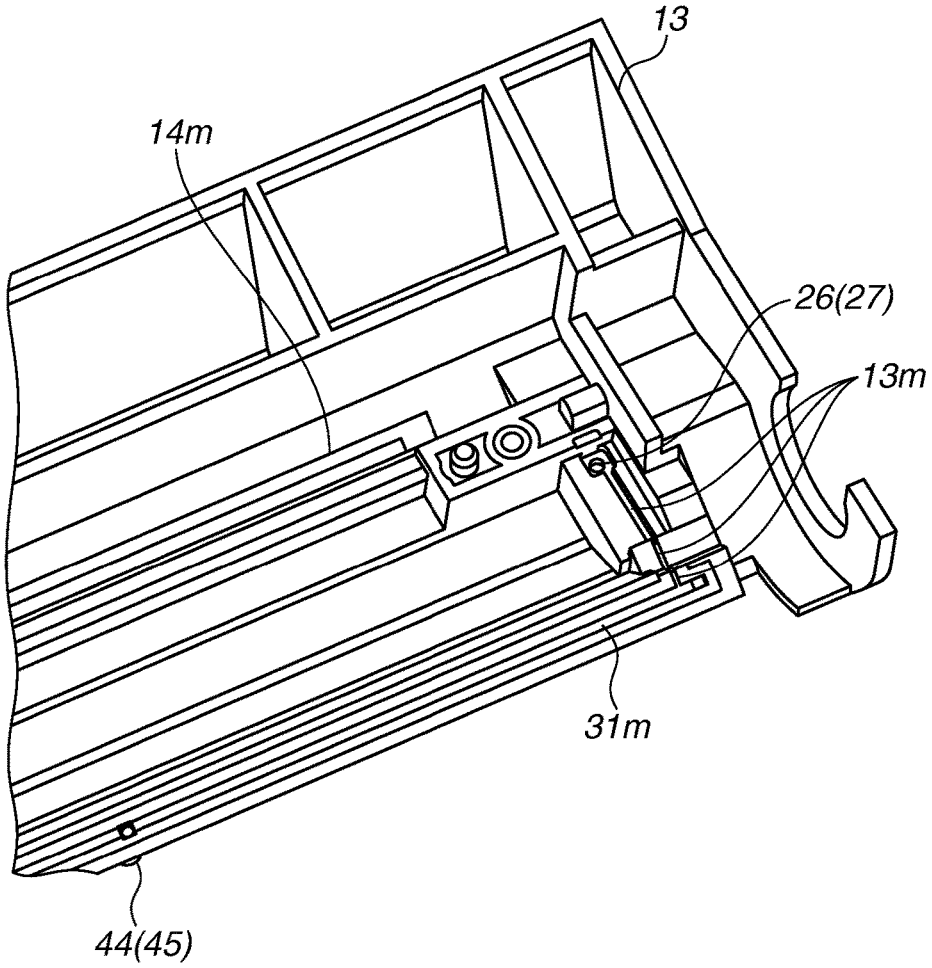
FIG. 11 is a schematic perspective view illustrating a cleaning frame member according to the first exemplary embodiment.
Figure 12:
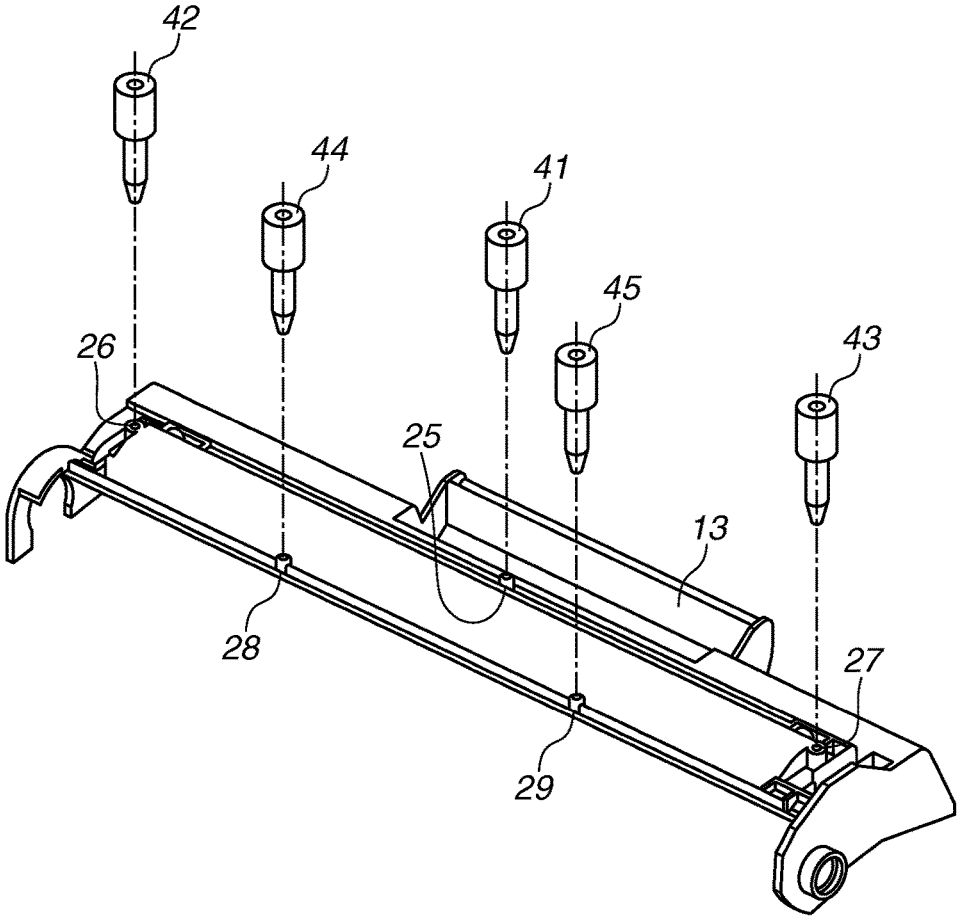
FIG. 12 is a perspective view illustrating an injection molding process for a cleaning frame member according to the first exemplary embodiment.
Figure 13:
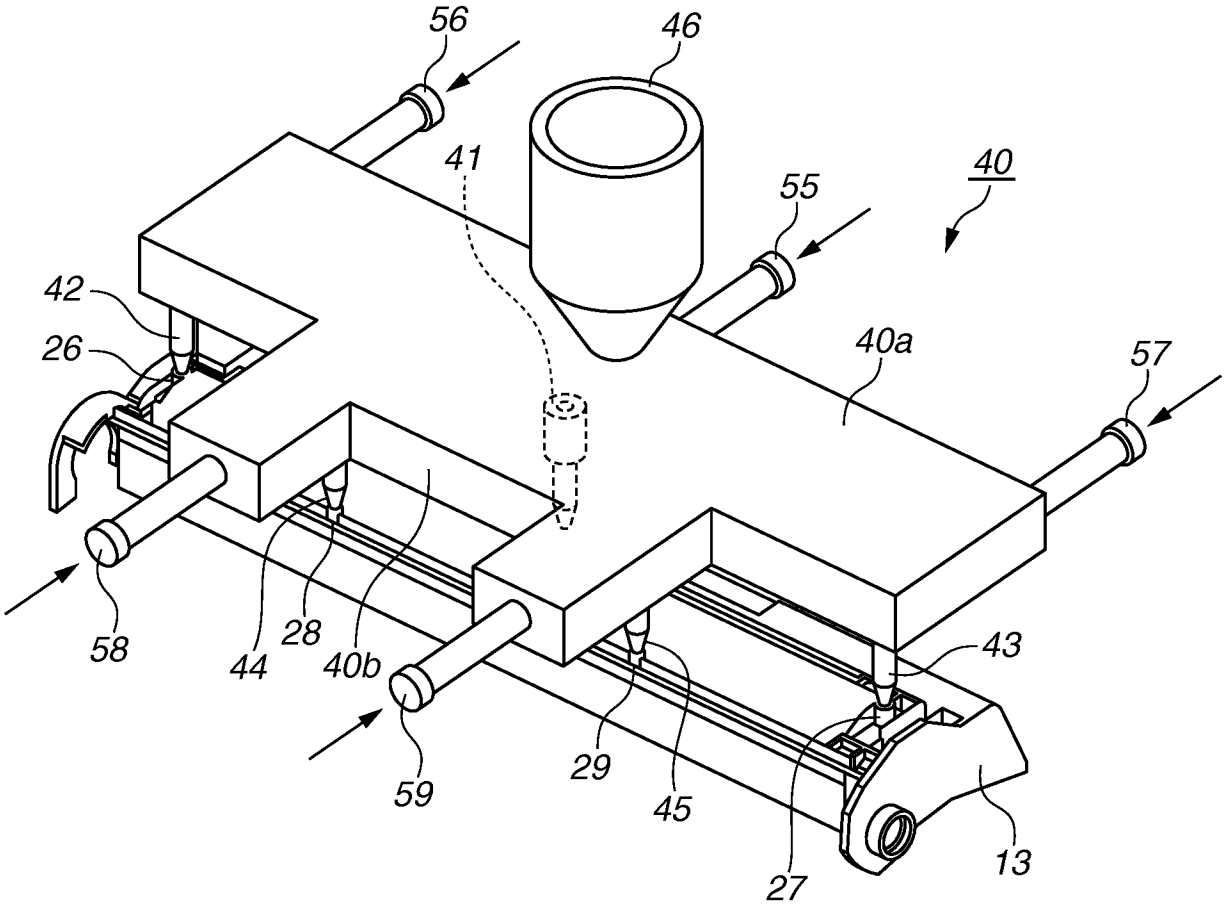
FIG. 13 is a perspective view illustrating an injection molding process for the cleaning frame member according to the first exemplary embodiment.
Figure 14:
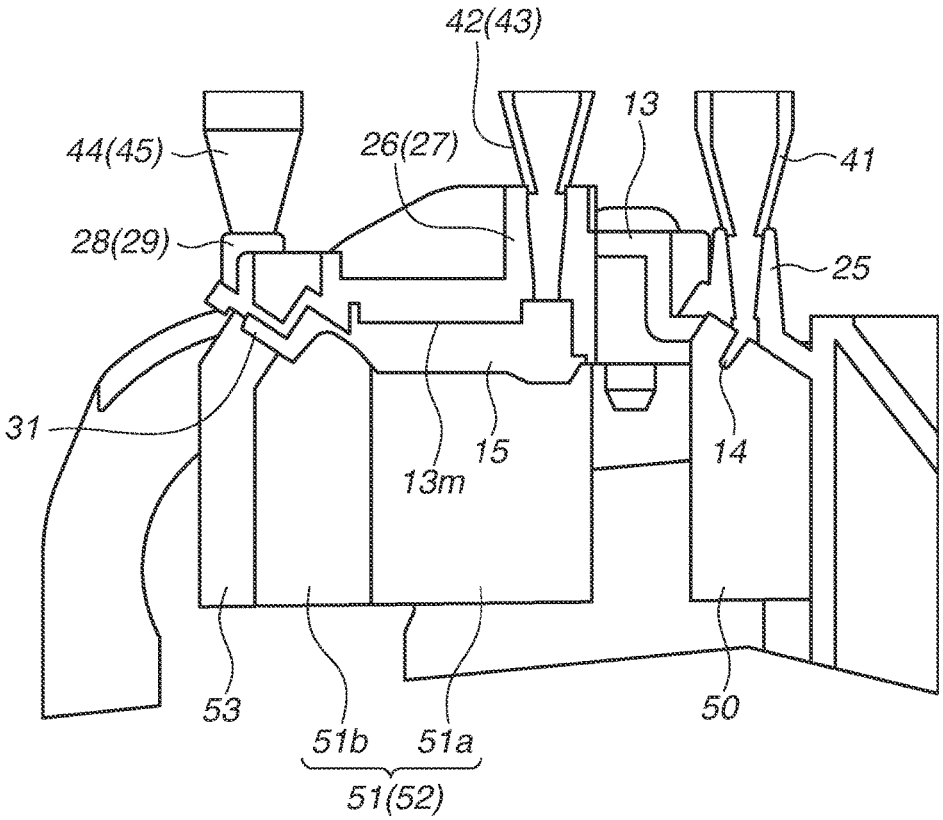
FIG. 14 is a schematic cross sectional view illustrating the injection molding process of resin for the cleaning frame member according to the first exemplary embodiment.

A method for forming the cleaning subunit is described with reference to FIGS. 11 to 17. The FIG. 11 is a schematic perspective view illustrating the cleaning frame member 13, and the FIGS. 12 to 14 are schematic cross sectional views illustrating a process for injection molding to the cleaning frame member.

(Injection Molding Process)

A process for injection molding of the vertical sealing portions 15 and 16 and the fixing portion 31 to the cleaning frame member 13 is described below. The FIG. 12 is a schematic perspective view illustrating injection ports of the cleaning frame member according to the present exemplary embodiment, and the FIG. 13 is a perspective view illustrating the cleaning frame member according to the present exemplary embodiment in a state of being set to a resin injection apparatus. The FIG. 14 is a partial enlarged view of a schematic cross sectional view at the time of injection molding of a resin to the cleaning frame member according to the present exemplary embodiment.

The cleaning frame member 13 to which injection ports 25 to 29 for injecting a molten resin and the vertical sealing portion 15, the cleaning blade lower sealing 14, and groove portions 13*m*, 14*m*, 31*m* for holding the fixing portion 31 are provided is prepared. The injection ports 25 to 29 are provided as holes penetrating the cleaning frame member 13. In the present exemplary embodiment, the injection ports 25 to 29 provided to the cleaning frame member 13 are disposed in such a manner that positions of the injection ports 25 to 29 in the longitudinal direction of the cleaning frame member 13 are shifted from each other.

As illustrated in FIG. 14, vertical sealing portion molds 51 and 52 for forming the vertical sealing portions 15 and 16 and a scooping sheet mold 53 for forming the fixing portion 31 are fixed to the cleaning frame member 13. As a result, a molten resin can be injected from the injection ports 26 and 27 to a space formed by the vertical sealing portion molds 51 and 52 and the cleaning frame member 13. In the present exemplary embodiment, the vertical sealing portion mold 51 (52) is divided into two parts, a mold 51*a* for forming the first portion 15*a* and a mold 51*b* for forming the second portions 15*b* to 15*c*. However, the configuration is not limited to this. Alternatively, a vertical sealing portion mold 51 in which the mold 51*a* and the mold 51*b* are integrated together may be used.

Similarly, a molten resin is allowed to be injected from the injection ports 28 and 29 to a space formed by the scooping sheet mold 53 and the cleaning frame member 13. In this configuration, the space formed by the scooping sheet mold 53 and the cleaning frame member 13 is made to communicate with the space formed by the vertical sealing portion molds 51 and 52 and the cleaning frame member 13.

According to the present exemplary embodiment, in addition to the vertical sealing portions 15 and 16 and the fixing portion 31, the cleaning blade lower sealing 14 is also molded in the same process. Therefore, a lower sealing mold 50 for forming the cleaning blade lower sealing 14 is also fixed to the cleaning frame member 13, and a molten resin is allowed to be injected from the injection port 25 to a space formed by the lower sealing mold 50 and the cleaning frame member 13.

Then, as illustrated in FIG. 13, the cleaning frame member 13 is set to a resin injection apparatus 40. The resin injection apparatus 40 includes a single resin supplying portion 40*a*, and a hopper portion 46 for supplying material of the cleaning blade lower sealing 14, the vertical sealing portions 15 and 16, and the fixing portion 31. Further, gates 41 to 45 for injecting a resin are disposed at positions each corresponding to a different one of the injection ports 25 to 29 in the same direction as the injection ports 25 to 29. Further, the injection ports 25 to 29 provided to the cleaning frame member 13 are also disposed in the same direction, so that the gates 41 to 45 can simultaneously abut on the injection ports 25 to 29.

Plungers 55 to 59 of the resin supplying portion 40*a* is driven in directions indicated by the arrows in FIG. 13 in a state that the gates 41 to 45 and the injection ports 25 to 29 respectively abut on each other. Thus, an elastomer resin that is a sealing material of the resin member 18 including the cleaning blade lower sealing 14, the vertical sealing portions 15 and 16, and the fixing portion 31 is injected from the gates 41, 42, and 43. The injected elastomer resin is poured into a space formed by the cleaning frame member 13 and the lower sealing mold 50, the vertical sealing portion molds 51 and 52, and the scooping sheet mold 53. Start timing, an amount of movement, and a movement speed of the cleaning frame member plungers 55 to 59 are adjusted and set in such manner that the poured elastomer resin is integrated.

After the completion of injection, the cleaning frame member 13 is removed from the cleaning blade lower sealing mold 50, the vertical sealing portion molds 51 and 52, and the scooping sheet mold 53 to perform the mold release. As a result, the cleaning blade lower sealing 14, the vertical sealing portions 15 and 16, and the fixing portion 31 can be integrally molded with the cleaning frame member 13.

Through the process described above, the cleaning subunit 12 is prepared.

(Cleaning Blade and End Sealing Attachment Process)

The cleaning blade 11*a* is disposed on the cleaning blade lower sealing 14, and is fixed at the attachment surfaces 21 and 22 provided to the both ends of the cleaning frame member 13 in the longitudinal direction N with a fixing member 32, such as a screw or a rivet, to the cleaning frame member 13. In this process, a gap between the cleaning frame member 13 and a plate metal 11*a*2 of the cleaning blade 11*a* is sealed by the cleaning blade lower sealing 14.

Figure 15A:
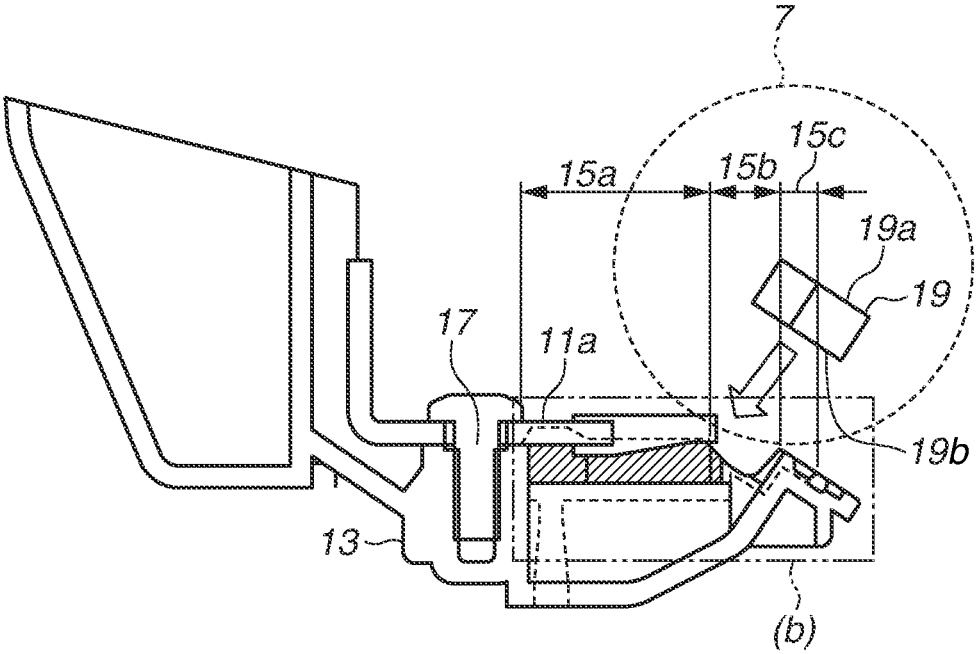
FIGS. 15A and 15B are schematic cross sectional views each illustrating assembly of the photosensitive drum unit according to the first exemplary embodiment.
Figure 15B:
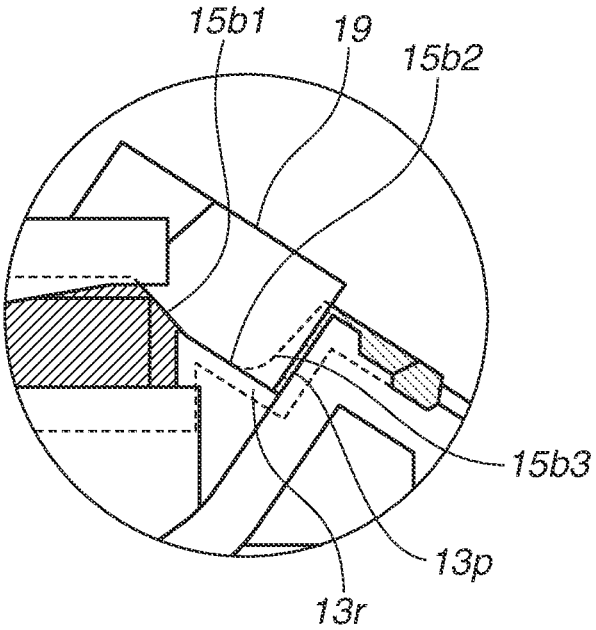

Then, as illustrated in FIGS. 15A and 15B, the end sealing 19 is attached to the attaching surface 13*t* of the cleaning frame member 13 so as to abut on the cleaning blade 11*a*, the photosensitive drum 7, and the scooping sheet 11*b* that are attached later. The end sealing 19 is fixed in such a manner that the adhesive surface 19*b* faces to the groove portion 13*m* of the cleaning frame member 13, that is, on the vertical sealing portion 15. In this process, as illustrated in FIG. 15B, the end sealing 19 is fixed to the cleaning frame member 13 in such a manner that the vertical sealing portion 15, more specifically the contact portion 15*b*3 protruding from the step portion 13*p* is squashed, and a gap between the end sealing 19 and the cleaning frame member 13 is sealed.

(Scooping Sheet Attaching Process)

Figure 16A:
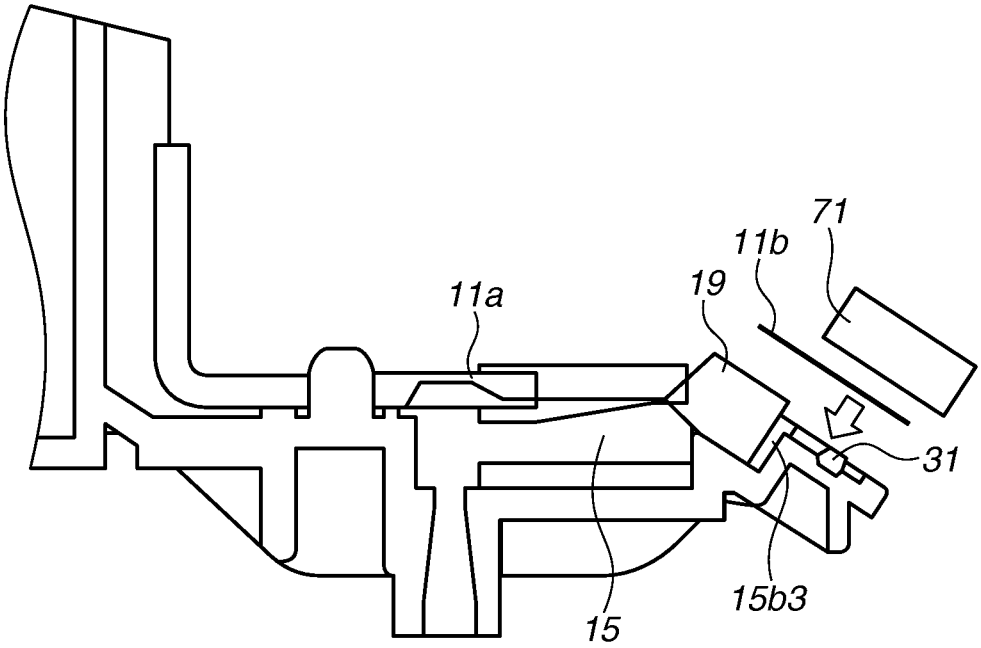
FIGS. 16A and 16B are schematic cross sectional views each illustrating the assembly of the photosensitive drum unit according to the first exemplary embodiment.
Figure 16B:
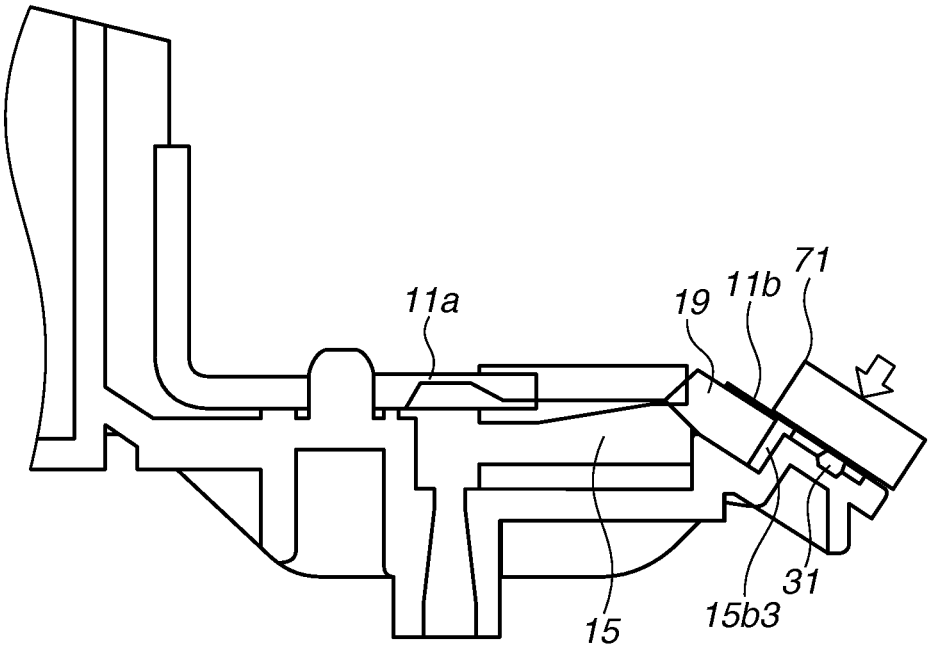

An attaching process of the scooping sheet 11*b* is described. In the present exemplary embodiment, a polyester sheet is used for the scooping sheet 11*b*. The scooping sheet 11*b* is disposed at a predetermined position on the fixing portion 31 molded on the cleaning frame member 13. Then, as illustrated in FIGS. 16A and 16B, a heating member 71, such as a heat bar, is pressed on the scooping sheet 11*b*. The heating member 71 is heated at a melting point of the fixing portion 31 or higher and a melting point of the material of the scooping sheet 11*b* or lower. The fixing portion 31 is melted by heat and pressure by the heating member 71, and the cleaning frame member 13 and the scooping sheet 11*b* are attached together. More specifically, not only the fixing portion 31 but also a part of the vertical sealing portions 15 and 16 are heated. As a result, the fixing portion 31 is melted and attached to the scooping sheet 11*b*, and a part of the vertical sealing portions 15 and 16 in the third portion 15*c* is also melted and closely attached to the scooping sheet 11*b*. Therefore, using a material having compatibility with the material of the scooping sheet 11*b* is desirable for the resin member 18.

Figure 17:
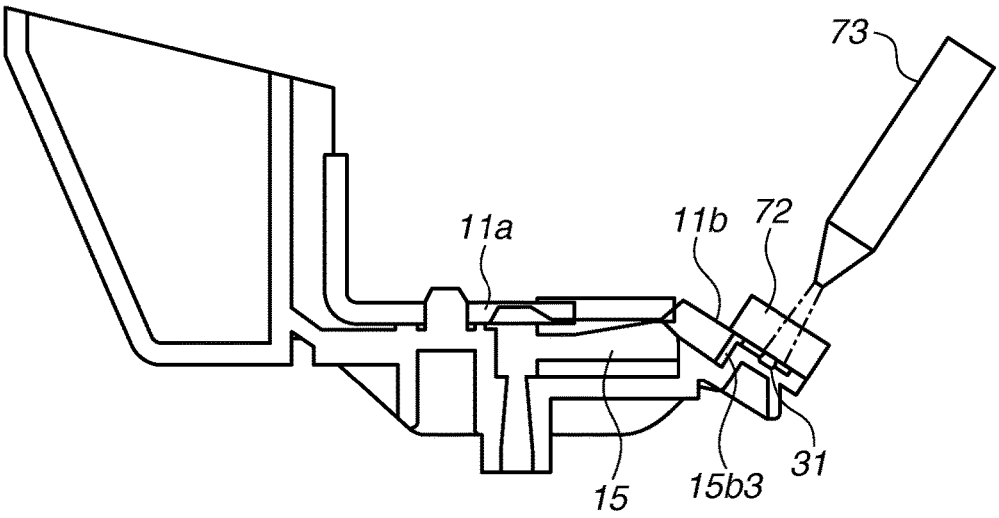
FIG. 17 is a schematic cross sectional view illustrating the assembly of the photosensitive drum unit according to the first exemplary embodiment.

Further, as a method for melting the fixing portion 31, other than pressing of the heating member 71, the fixing portion 31 may be melted by using a sheet material having a high optical transparency for the scooping sheet 11*b* and performing laser irradiation to the fixing portion 31. In this case, as illustrated in FIG. 17, the scooping sheet 11*b* is fixed by a transparent fixing member 72, such as a glass, having a high optical transparency, and the laser irradiation is performed to the fixing portion 31 and a part of the vertical sealing portions 15 and 16 provided in the third portion 15*c* by allowing a laser head 73 to scan. Any material that absorbs the laser beam and can be melted may be used for the resin member 18. Examples of such material include a resin that is melted by heat and includes a laser reactant, such as carbon, for absorbing light. In the present exemplary embodiment, a styrene-based resin containing 0.5 to 12 parts by mass of carbon is used as the resin member 18.

After the scooping sheet 11*b* is fixed to the cleaning subunit 12, the photosensitive drum unit 11 is prepared by fixing the photosensitive drum 7 and the charging roller 8 to a predetermined position. Then, the cartridge is prepared by integrating the development unit 10 with the photosensitive drum unit 11.

The injection process is desired to be performed in a state that each of the molds 50 to 53 abuts on the cleaning frame member 13 in such a manner that a resin does not leak out. The injection process may be performed after sequentially allowing the molds 50 to 53 to abut on the cleaning frame member 13, other than allowing the molds 50 to 53 to simultaneously abut on the cleaning frame member 13, which is the case according to the present exemplary embodiment.

(Effect of the Present Exemplary Embodiment)

According to the present exemplary embodiment, other than the effect achieved by the configuration of the cartridge B, the manufactured cartridge B can allow a plurality of components, such as the cleaning blade lower sealing 14, the vertical sealing portions 15 and 16, the fixing portion 31 to be manufactured by the resin injection apparatus 40 in the same process. Therefore, the productivity can be increased, and since a process for attaching the sealing member that is a soft body member to the cleaning frame member is not included, the assembly by the automatic machine becomes possible.

Further, the vertical sealing portions 15 and 16 and the fixing portion 31 are integrally formed together with the same resin. As a result, the resin injection apparatus 40 for forming the vertical sealing portions 15 and 16 and the fixing portion 31 can be configured by the a single resin supplying portion 40*a*. Further, according to the present exemplary embodiment, an elastomer resin is injected from the five gates However, the configuration is not limited to the one described above, and the number of gates can be reduced. As a result, the injection port that is required to be a position and a size corresponding to the gate can be reduced, and a degree of freedom can be increased of a shape of the vertical sealing portions 15 and 16 and the fixing portion 31 Therefore, downsizing of the cartridge becomes possible. In a case where the number of gates is reduced, it is desirable for injecting an elastomer resin from the gate provided to a portion of the cleaning frame member 13 that does not face the third portion 15*c* to the third portion 15*c*. Thus, an elastomer resin is injected from the gate provided to the portion of the cleaning frame member 13 that does not face the third portion 15*c*, so that interfaces that are formed between members formed of the elastomer resin can be reduced. As a result, in the third portion 15*c* formed between the scooping sheet 11*b* and the cleaning frame member 13, the vertical sealing portion 15 becomes a broken shape whereby decreasing of sealability can be suppressed.

Figure 18:
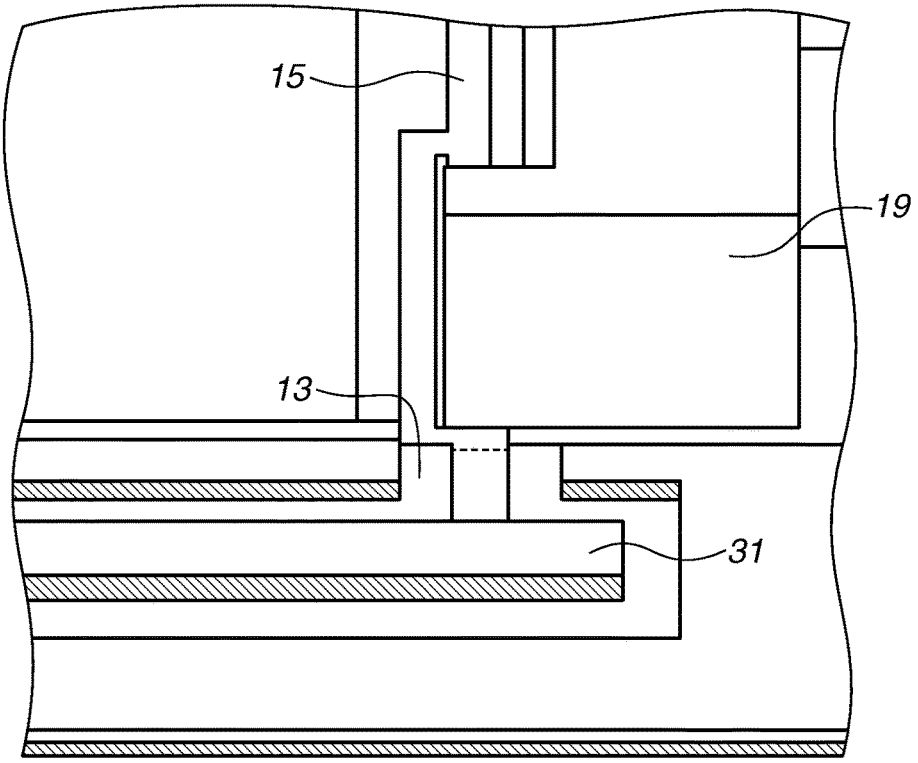
FIG. 18 is a partial schematic front view illustrating a cleaning subunit according to a first modified embodiment.

In the present exemplary embodiment, for attaching to the attaching surface 13*t* of the cleaning frame member 13, the groove portion 13*m* is provided to the attaching surface 13*t*, and the vertical sealing portion 15 (16) and the fixing portion 31 are connected together via the groove portion 13*m* so that the configuration is molded in an integral manner. However, the configuration is not limited to this. In a first modified example, As illustrated in FIG. 18, the vertical sealing portions 15 and 16 may be disposed in such a manner that the vertical sealing portions 15 and 16 avoid the end sealing 19. Specifically, the vertical sealing portions 15 and 16, in an area where the vertical sealing portions 15 and 16 are disposed along with the end sealing 19 in the longitudinal direction N, are disposed at a center side of the cartridge from the end seal 19. On the other hand, the vertical sealing portions 15 and 16, in an area where the vertical sealing portions 15 and 16 are disposed along with the end sealing 19 in the lateral direction M, extend in the longitudinal direction N along the outer periphery of the end sealing 19. Through the above manner, the attaching surface 13*t* for attaching the end sealing 19 can have a sufficient area, and the end sealing 19 can be satisfactorily attached to the cleaning frame member 13.

In addition, according to the above exemplary embodiment, the cleaning blade lower sealing 14, the vertical sealing portions 15 and 16, and the resin member 18 including the fixing portion 31 are formed as separate bodies. However, the configuration is not limited to this. Alternatively, the cleaning blade lower sealing 14, the vertical sealing portions 15, 16, and the resin member 18 including the fixing portion 31 can be integrally formed together.

Figure 19A:
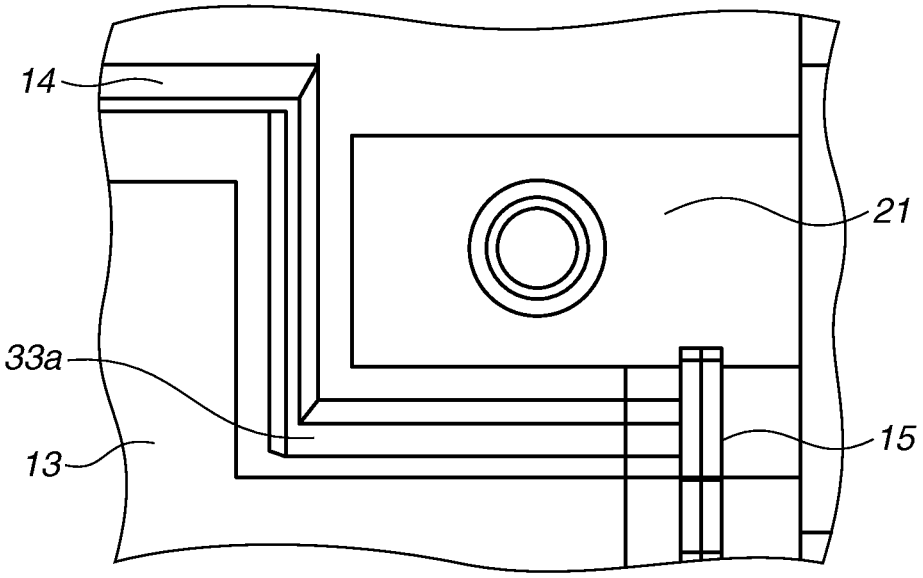
FIGS. 19A and 19B are partial schematic front views each illustrating a cleaning subunit according to a second modified embodiment.

Specifically, in a second modified example, as illustrated in FIG. 19A, a first connecting portion 33*a* can be provided at a position where the first connecting portion 33*a* avoids the attachment surface 21, along the outer periphery of the attachment surface 21. In this case, the first connecting portion 33*a* is formed between the metal plate portion 11*a*2 of the cleaning blade 11*a* and the cleaning frame member 13. More specifically, the cleaning blade lower sealing 14 and the vertical sealing portions 15 and 16 are continuously formed, using the same material, to an injection molding member via the first connecting portion 33*a*. As a result, by a configuration that the gate is not provided to the cleaning frame member of the portion that faces the vertical sealing portions 15 and 16, the number of gates can be reduced whereby a degree of freedom of manufacturing can be increased.

Figure 19B:
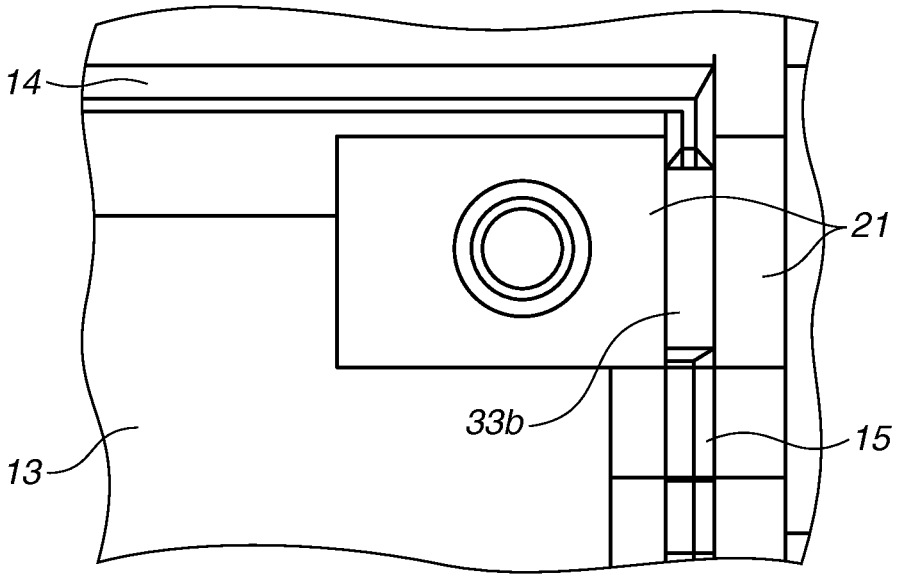

Besides this, as illustrated in FIG. 19B, the cleaning blade lower sealing 14 and the vertical sealing portions 15 and 16 can be integrated together with a second connecting portion 33*b* provided inside the groove portion traversing the attachment surfaces 21 and 22. Namely, with the second connecting portion 33*b* dividing the attachment surfaces 21 and 22, the cleaning blade lower sealing 14 and the vertical sealing portions 15 and 16 are continuously formed using the same material to an injection molding member. As a result, by a configuration that the gate is not provided to the cleaning frame member of the portion that faces the vertical sealing portions 15 and 16, the number of gates can be reduced whereby a degree of freedom of manufacturing can be increased.

According to the above exemplary embodiment, the laser irradiation is performed to the fixing portion 31, and the fixing portion 31 is melted to fix the scooping sheet 11*b*. In this case, for allowing the fixing portion 31 to absorb the laser beam and to be melted, a resin to which a laser reactant, such as carbon, for absorbing light is added so as to be melted by heat is used in the present exemplary embodiment for example. Therefore, the resin member 18 constituting the fixing portion 31 is a hard member in comparison with a conventional sealing member.

The rubber portion 11*a*1 of the cleaning blade 11*a* abuts on the photosensitive drum 7 and is deflected, so that the vertical sealing portion 15 (16) is compressed. That is, when the vertical sealing portion 15 (16) is hard and the repulsive force is large, abutment pressure of the rubber portion 11*a*1 of the cleaning blade 11*a* to the photosensitive drum 7 becomes large. Therefore, some problems have easily occurred. For example, cleaning performance of the cleaning blade 11*a* is influenced, and friction force against the photosensitive drum 7 becomes too large and the rubber portion 11*a*1 is turned up.

Figure 20A:
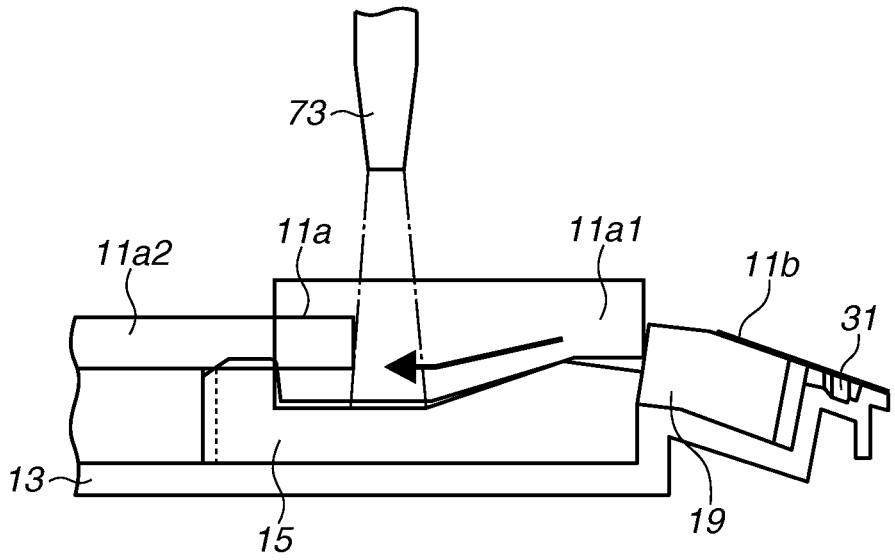
FIGS. 20A and 20B are partial schematic front views each illustrating a cleaning subunit according to a third modified embodiment.

In a third modified embodiment, a member that transmits the laser beam is used as the rubber portion 11*a*1 and, as illustrated in FIG. 20A, and the laser beam is irradiated to a contact portion between the rubber portion 11*a*1 and the vertical sealing portion 15 (16). With such a manner, a contact surface of the vertical sealing portion (16) can be melted by the irradiated laser beam. As a result, a problem in which the vertical sealing portion 15 (16) is deformed and the abutment pressure of the rubber portion 11*a*1 to the photosensitive drum 7 caused by the vertical sealing portion 15 (16) becomes large can be suppressed.

Figure 20B:
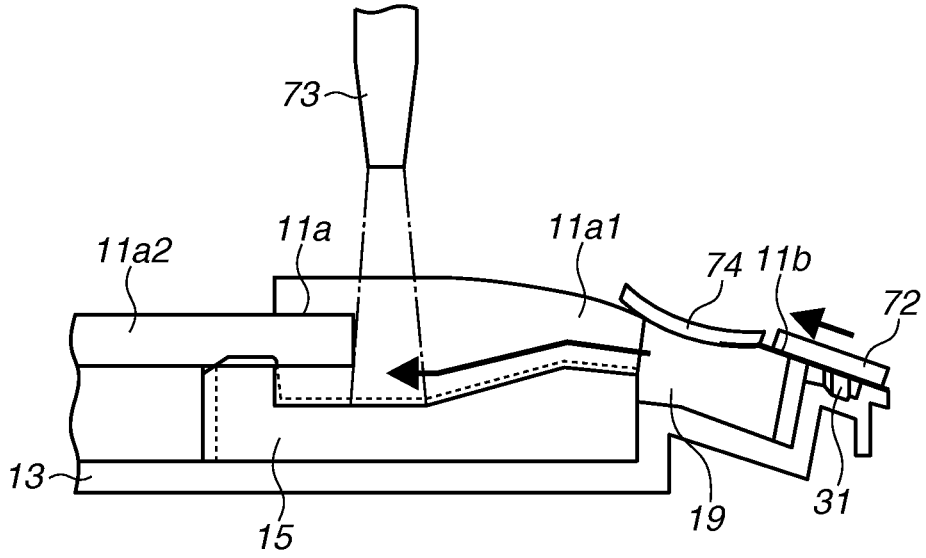

As illustrated in FIG. 20B, a pseudo drum 74 (pressing member) that imitates a shape of the photosensitive drum 7 and transmits the laser beam can be used. More specifically, after the rubber portion 11*a*1 is deformed by the pseudo drum 74 similarly to an assembled state of the photosensitive drum 7, the laser beam is radiated on the rubber portion 11*a*1, and the contact surface may be melted in advance before the photosensitive drum 7 is assembled. As a result, the rubber portion 11*a*1 and the vertical sealing portion 15 (16) can be in contact with each other in a closer condition to the assembled state of the photosensitive drum 7, so that repulsive force at longitudinal both ends can be reduced while maintaining the sealability. Further, at the boundary between the vertical sealing portion 15 (16) and the end sealing 19 (20), an elastomer resin of the vertical sealing portion 15 (16) is melted by the irradiated laser beam and is integrated with the melted end sealing 19 (20), so that the sealability can be improved. As illustrated in FIG. 20B, a process for deforming the vertical sealing portion 15 (16) by radiating the laser via the pseudo drum 74 and the rubber portion 11*a*1 may be continuously performed with a process for fixing the scooping sheet 11*b* to the fixing portion 31. Thus, the process for deforming the vertical sealing portion 15 (16) and the process for fixing the scooping sheet 11*b* to the fixing portion 31 are continuously performed, so that the productivity can be increased.

According to the first exemplary embodiment, the vertical sealing portions 15 and 16 and the fixing portion 31 are integrally molded using the same material with the cleaning frame member 13 so as to be the resin member 18. However, the configuration is not limited to this. Alternatively, the vertical sealing portions 15 and 16 may be formed with a first sealing material, and the fixing portion 31 is formed with a second sealing material different from the first sealing material. Then, the vertical sealing portion 15 and the fixing portion 31 may be integrally formed together. In a second exemplary embodiment, description for the same configuration as the first exemplary embodiment is omitted, and description will be given for the configuration in which vertical sealing portions 15 and 16 is formed with a first sealing material, a fixing portion 31 is formed with a second sealing material, and the vertical sealing portion 15 and the fixing portion 31 are integrally formed together, with a description mainly about a sealing configuration of a cleaning subunit 12.

(Sealing Configuration of Cleaning Subunit)

Figure 21:
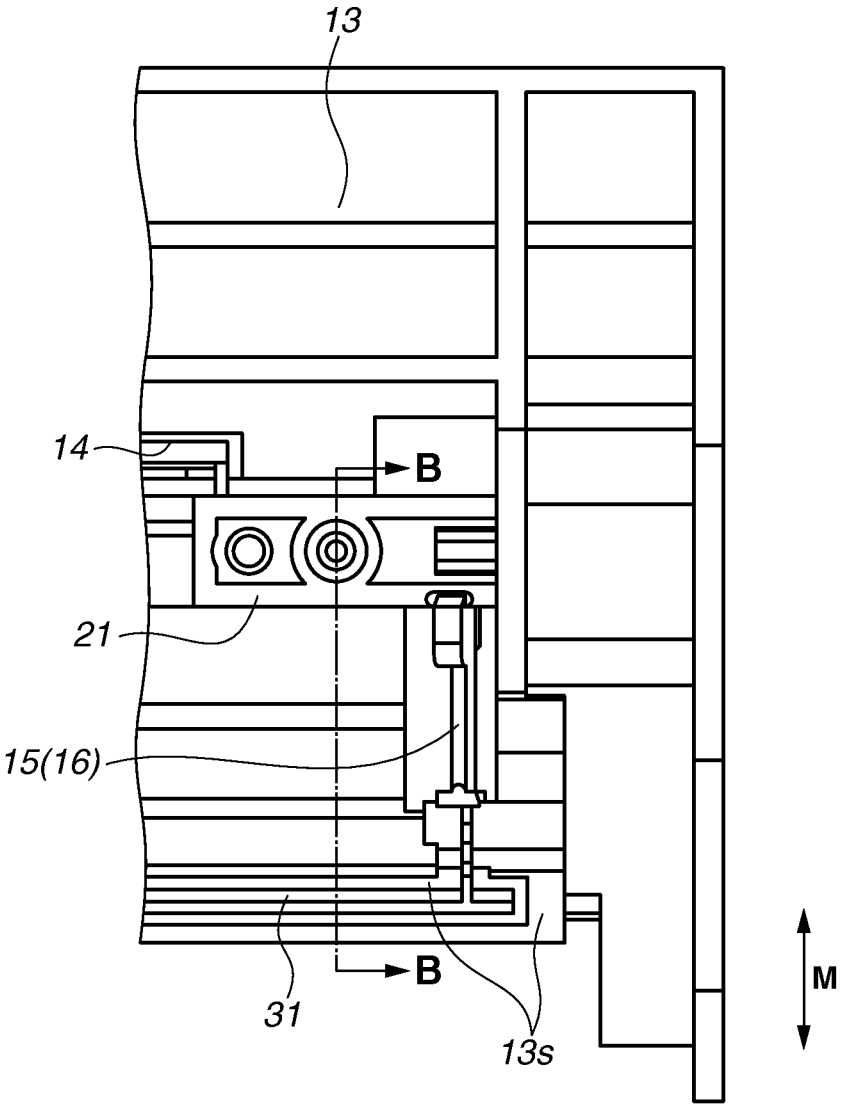
FIG. 21 is a schematic front view illustrating a vicinity of a vertical sealing of a cleaning subunit according to the second exemplary embodiment.
Figure 22:
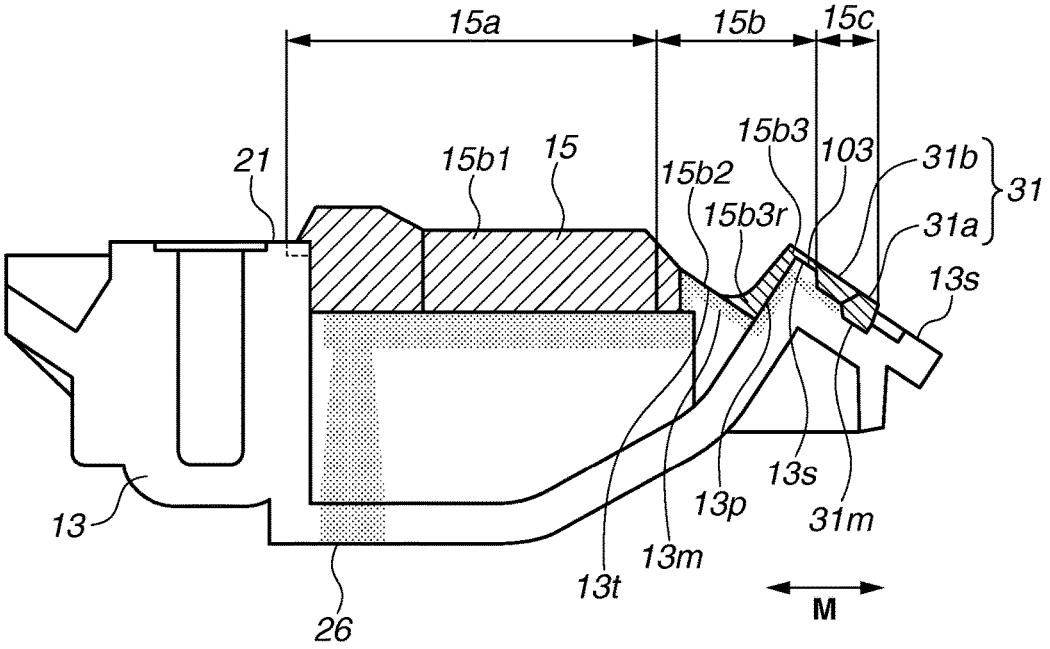
FIG. 22 is a schematic cross sectional view illustrating a vicinity of the vertical sealing of the cleaning subunit according to the second exemplary embodiment.
Figure 23A:
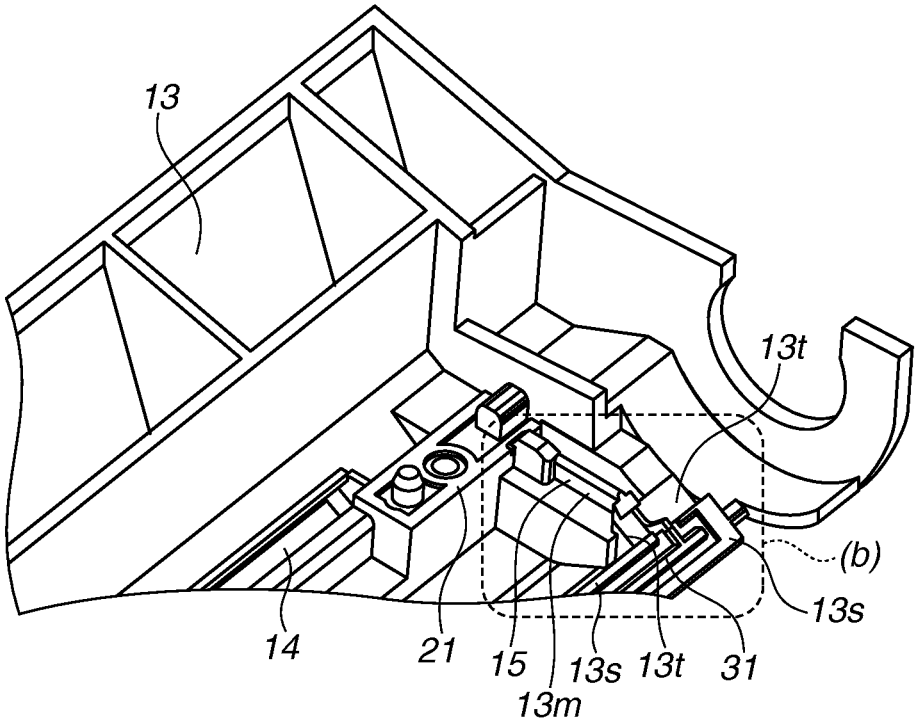
FIGS. 23A and 23B are schematic perspective views each illustrating a vicinity of the vertical sealing of the cleaning subunit according to the second exemplary embodiment.
Figure 23B:
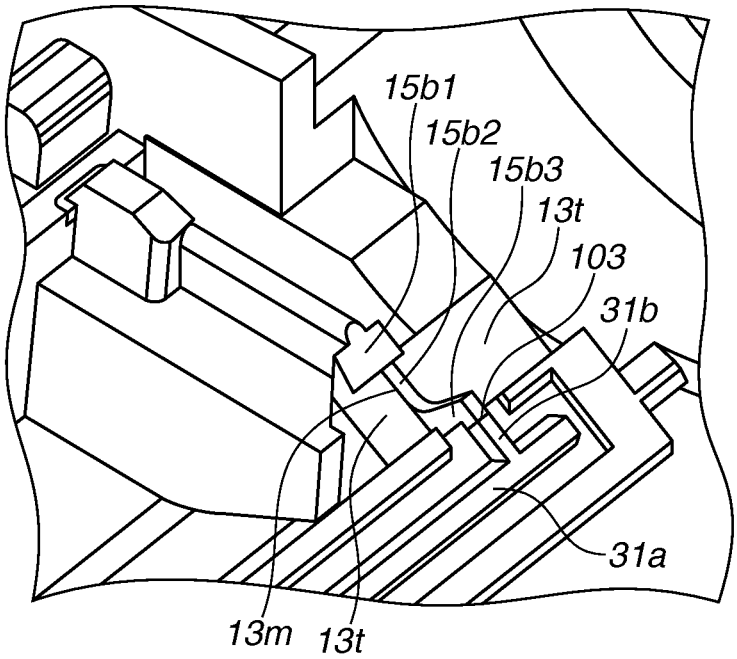

The sealing configuration of the cleaning subunit according to the present exemplary embodiment is described in detail with reference to FIGS. 21 to 24. FIG. 21 is a schematic front view illustrating a vicinity of the vertical sealing portion 15 of the cleaning subunit 12 according to the present exemplary embodiment. FIG. 22 is a diagram illustrating the cleaning subunit 12 taken along the line C-C illustrated in FIG. 21. FIGS. 23A and 23B are schematic perspective views illustrating a vicinity of the vertical sealing portion 15 of the cleaning subunit 12 according to the present exemplary embodiment, and FIG. 23B is a diagram illustrating a partial detail of FIG. 23A.

Similarly to FIG. 3 of the first exemplary embodiment, a cleaning blade 11*a* and a scooping sheet 11*b* are attached to the cleaning subunit 12. The scooping sheet 11*b* abutting on a photosensitive drum 7 to prevent leakage of waste toner is attached to a cleaning frame member 13 (cartridge frame member) via the fixing portion 31. In the present exemplary embodiment, scooping sheet 11*b* is fixed to the cleaning frame member 13 by the fixing portion 31 to which the scooping sheet 11*b* is welded.

As illustrated in FIG. 21, a cleaning blade lower sealing 14, the vertical sealing portions 15 and 16, end sealings 19 and 20, and the fixing portion 31 are provided to the cleaning subunit 12. Specifically, similarly to the first exemplary embodiment, the cleaning blade lower sealing 14 is provided over blade attachment surfaces 21 and 22 each provided at a corresponding end of the ends in a longitudinal direction N of the cleaning frame member 13. The vertical sealing portions 15 and 16 formed with the first sealing material, as illustrated in FIGS. 21 to 24, are provided in such a manner that the vertical sealing portions 15 and 16 connects to the fixing portion 31 for fixing the scooping sheet 11*b* from the vicinity of the blade attachment surfaces 21 and 22. That is, the vertical sealing portions 15 and 16 and the fixing portion 31 are integrally molded with the cleaning frame member 13. Thus, a gap between the cleaning blade 11*a* and the cleaning frame member 13 is sealed by the cleaning blade lower sealing 14 and the vertical sealing portions 15 and 16.

First sealing material may be any of resin that has elasticity and is injection moldable, so that an elastomer resin can be used. As the first sealing material, it is desirable for using a material that includes a similar material to the cleaning frame member 13 and has elasticity, since the material does not have to be separated from the cleaning frame member 13 at the time of recycling of the process cartridge B. Therefore, according to the present exemplary embodiment, a styrene-based elastomer resin is used that includes a similar material to the cleaning frame member 13 including a polystyrene resin. Alternatively, a silicone-based rubber or a soft rubber can be used. However, the rubber portion 11*a*1 of the cleaning blade 11*a* abuts on the photosensitive drum 7 and is deflected, so that the vertical sealing portion 15 (16) is compressed. When repulsive force of the vertical sealing portion 15 (16) is large, abutment pressure of the rubber portion 11*a*1 of the cleaning blade 11*a* to the photosensitive drum 7 becomes large. Therefore, some problems may occur. For example, cleaning performance of the cleaning blade 11*a* is influenced, and friction force against the photosensitive drum 7 becomes too large and the rubber portion 11*a*1 is turned up. Thus, it is desirable to select a material that has a low repulsive force even when compressed, namely that is soft and has a low elastic modulus. According to the present exemplary embodiment, a material having a hardness of about 20 to 30 according to the JIS K6253 test method is used by taking into consideration of moldability.

Figure 24:
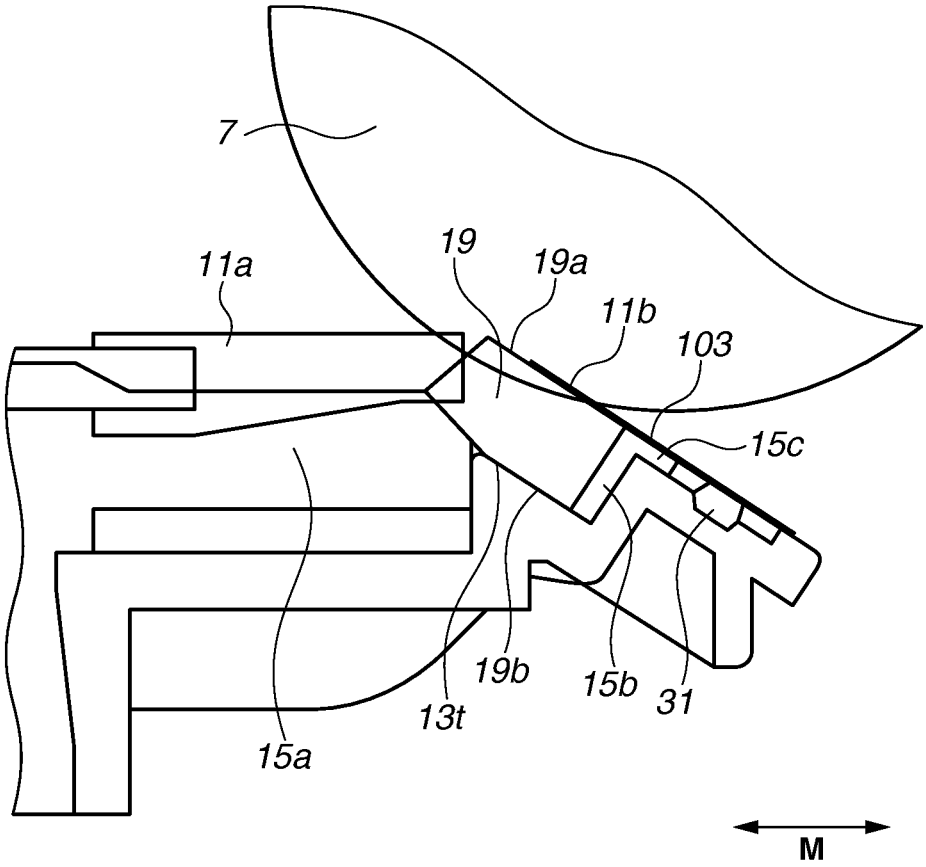
FIG. 24 is a schematic cross sectional view illustrating a vicinity of the vertical sealing portion of the photosensitive drum unit according to the second exemplary embodiment.

As illustrated in FIG. 24, the end sealing 19 (20) includes a surface 19*a* (20*a*) abutting on the photosensitive drum 7, and an adhesive surface 19*b* (20*b*) for adhering to an attaching surface 13*t* of the cleaning frame member 13. The end sealings 19 and 20 is disposed to abut on the photosensitive drum 7, so that the gap between the photosensitive drum 7 and the cleaning frame member 13 is sealed and leakage of the toner to the outside of the cartridge B is prevented. As illustrated in FIGS. 23A and 23B, in order that the end sealings 19 and 20 are attached to the attaching surface 13*t* of the cleaning frame member 13, the groove portion 13*m* is provided to the attaching surface 13*t*, and the vertical sealing portion 15 (16) and the fixing portion 31 are connected together via the groove portion 13*m* so that the configuration is molded in an integral manner. For the end sealing 19 (20), a flexible member, such as felt or non-woven fabric, pile made in such a manner that fibers are woven into fabric, or electrostatic flocking is used for a surface 19*a* (20*a*).

The vertical sealing portions 15 and 16 are described in detail. According to the present exemplary embodiment, vertical sealing portions 15 and 16 is symmetrically configured relative to the longitudinal direction N of the cleaning frame member 13. Therefore, the vertical sealing portion 15 is taken as an example and described below. As illustrated in FIG. 22, the vertical sealing portion 15 extends in a lateral direction M crossing the longitudinal direction N, and includes three portions that are a first portion 15*a*, a second portion 15*b*, and a third portion 15*c*.

(First Portion 15*a* of Vertical Sealing)

As illustrated in FIG. 22, the first portion 15*a* of the vertical sealing portion 15 is disposed between the cleaning blade 11*a* and the cleaning frame member 13. More specifically, similarly to the description for the first exemplary embodiment with reference to FIG. 10, the first portion 15*a* extends from the cleaning frame member 13 toward the cleaning blade 11*a*, and abuts on the cleaning blade 11*a*. In this case, it is desirable for the first portion 15*a* to be disposed in such a manner that a line, connecting between a contact portion of vertical sealing portion 15 with the cleaning frame member 13 and a contact portion of vertical sealing portion 15 with the cleaning blade 11*a*, non-orthogonally crosses the longitudinal direction N. Thus, the vertical sealing portion 15 is disposed to be tilted to the longitudinal direction N, so that the vertical sealing portion 15 is fixed in a state of being deformed in a bent manner between the cleaning blade 11*a* and the cleaning frame member 13. As a result, repulsive force of the cleaning blade 11*a* to a rubber portion 11*a*1 generated by deforming of the vertical sealing portion 15 can be reduced. Therefore, it can be suppressed that abutment pressure to be received by the photosensitive drum 7 from the rubber portion 11*a*1 of the cleaning blade 11*a* is increased in the vicinity of the vertical sealing portions 15 and 16 whereby cleaning of the surface of the photosensitive drum 7 can be uniformly performed and satisfactorily stabilized. Although the first portion 15*a* may have a tilted shape only for a portion abutting on the rubber portion 11*a*1 of the cleaning blade 11*a*, a portion abutting on a metal plate portion 11*a*2 may also be the similar shape. A direction of tilting may be an inside direction (FIG. 10A) of the cleaning frame member 13 in the longitudinal direction N, or an outside direction (FIG. 10B). In the present exemplary embodiment, for shortening a length of the cleaning frame member 13 and the cleaning blade 11*a* in the longitudinal direction N, the shape tilted inside is desirable and adopted. Further, in terms of toner sealing, the shape tilted inside of the cleaning frame member 13 in the longitudinal direction N is adopted.

(Second Portion 15*b* of Vertical Sealing)

The second portion 15*b* of the vertical sealing portion 15 is described. As illustrated in FIG. 22, the second portion 15*b* is formed in such a manner that the second portion 15*b* connects to the first portion 15*a* in the longitudinal direction N. As illustrated in FIG. 24, the second portion 15*b* is disposed in such a manner that the second portion 15*b* is compressed by a cleaning frame member 13 and the end sealing 19 so as to seal between the cleaning frame member 13 and the end sealing 19.

More specifically, as illustrated in FIG. 23B, the second portion 15*b* comes in contact with the end sealing 19 at three contact portions (15*b*1, 15*b*2, 15*b*3). The contact portion 15*b*1 forms an inclined surface that smoothly connects the first portion 15*a* to the attaching surface 13*t*. As a result, in a case where the end sealing 19 fails to close a step between the vertical sealing portion 15 and the attaching surface 13*t* when the end sealing 19 is attached to the attaching surface 13*t*, it is prevented that and a gap occurs whereby the toner leakage is reliably prevented.

The contact portion 15*b*2 connecting with the contact portion 15*b*1 is made to have almost the same height as the attaching surface 13*t* so that an adhesive layer 19*b* and the attaching surface 13*t* are reliably attached together. In order that the contact portion 15*b*2 is made to have almost the same height as the attaching surface 13*t*, the groove portion 13*m* is provided to the attaching surface 13*t* of the cleaning frame member 13, and the contact portion 15*b*2 is provided to the groove portion 13*m*.

The contact portion 15*b*3 smoothly connected from the contact portion 15*b*2, as illustrated in FIG. 22, is disposed to a step portion 13*p* which is a portion where the attaching surface 13*t* is connected to a fixing surface 13*s* to which the scooping sheet 11*b* is attached. The contact portion 15*b*3 is made to be a rib shape protruding from the step portion 13*p* in the direction in which the attaching surface 13*t* extends. In a corner portion 13*r* at which the attaching surface 13*t* crosses the step portion 13*p*, a curved shape 15*b*3*r* is provided so that the contact portions 15*b*2 and 15*b*3 are smoothly connected together. With such a configuration, in a case where the end sealing 19 fails to close the corner portion 13*r* at which the attaching surface 13*t* of the cleaning frame member 13 crosses the step portion 13*p* when the end sealing 19 is attached to the cleaning frame member 13, it is prevented that a gap occurs. As a result, the toner leakage from between the end sealing 19 and the cleaning frame member 13 is reliably prevented. In addition, the contact portion 15*b*3 is made to be a rib shape with a narrow width, and repulsive force, which is generated by the contact portion 15*b*3 compressed by the end sealing 19 and fixed in a state of being deformed, to the end sealing 19 can be reduced. According to the present exemplary embodiment, the width of the contact portion 15*b*3 is about 0.6 mm. As a result, as illustrated in FIG. 24, the contact portion 15*b*3 can be easily compressed and deformed by the end sealing 19, and it is satisfactorily prevented that the gap is generated between the end sealing 19 and the cleaning frame member 13, and the toner leakage is reliably prevented.

(Third Portion 15*c* of Vertical Sealing and Fixing Portion 31)

The third portion 15*c* is described. The third portion 15*c*, as illustrated in FIG. 24, is formed between the scooping sheet 11*b* and the cleaning frame member 13. One end of the third portion 15*c* is formed in such a manner that the third portion 15*c* connects to the connection portion 15*b*3 of the second portion 15*b*. On the other hand, the other end of the third portion 15*c* is continuously formed with the fixing portion 31 formed of the second sealing material. More specifically, as illustrated in FIG. 22, the fixing portion 31 includes an attaching portion 31*a* extending along the longitudinal direction N of the cleaning frame member 13 and a connection portion 31*b* provided to both ends in the longitudinal direction N and extending along the lateral direction M. The connection portion 31*b* is connected to the other end of the third portion 15*c*, and the vertical sealing portion 15 and the fixing portion 31 are integrally formed together. That is, the vertical sealing portion 15 and the resin member 18 are in contact with each other, and a boundary portion 103 that is an interface is formed in such a manner that the boundary portion 103 is disposed between the scooping sheet 11*b* and the cleaning frame member 13, namely at the third portion 15*c*. As a result, the gap does not occur between the fixing portion 31 and the third portion 15*c* in between the scooping sheet 11*b* and the cleaning frame member 13 whereby the toner leakage can be reliably prevented.

Figure 25A:
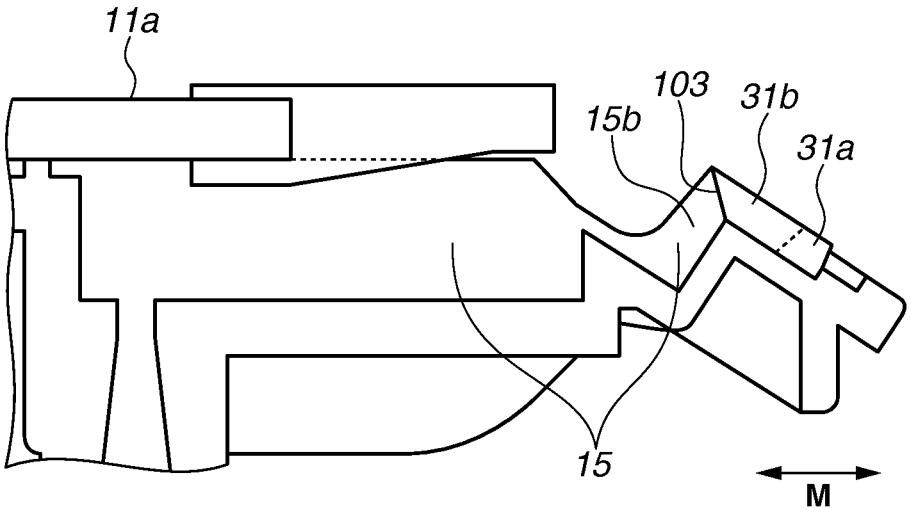
FIGS. 25A and 25B are schematic cross sectional views each illustrating a part of a photosensitive drum unit according to a modified embodiment of the second exemplary embodiment.
Figure 25B:
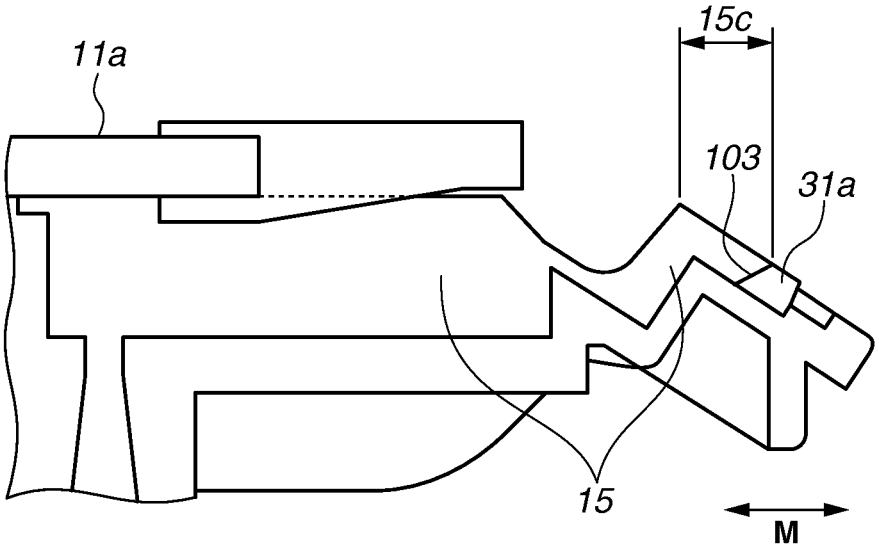

According to the present exemplary embodiment, the third portion 15*c* is provided. Alternatively, the third portion 15*c* may is provided, and as illustrated in FIG. 25A, the second portion 15*b* (contact portion 15*b*3) and the fixing portion 31 may be in contact with each other and be integrated together. Further, as illustrated in FIG. 25B, the connection portion 31*b* is not provided, and the third portion 15*c* and the attaching portion 31*a* may be in contact with each other and be integrated together. That is, the boundary portion 103 which is an interface between the vertical sealing portion 15 and the fixing portion 31 may be provided in a range in which the interface does not cross the attaching portion 31*a* in the lateral direction in which the vertical sealing portion 15 extends, in an area held between the scooping sheet 11*b* and the cleaning frame member 13.

Further, according to the present exemplary embodiment, an elastomer resin is used as the second sealing material that is different from the first sealing material used for the vertical sealing portion 15. Specifically, with the configuration in which a material having a hardness of about 50 according to JIS K6253 test method that is hard in comparison with the first sealing material is used as the second sealing material, so that the scooping sheet 11*b* can be disposed to the cleaning frame member 13 with high accuracy. On the other hand, a resin having an elastic modulus of 2.5 MPa to 10 MPa is used as the second sealing material so that the fixing portion 31 can be molded to the frame member similarly to molding of other sealing members, such as the vertical sealing portions 15 and 16.

Similarly to the first sealing material, as the second sealing material, it is desirable to use a material that includes a similar material to the cleaning frame member 13 and has elasticity, since the material does not have to be separated from the cleaning frame member 13 at the time of recycling of the process cartridge B. Therefore, in the present exemplary embodiment, a styrene-based elastomer resin that includes a similar material to the cleaning frame member 13 formed of a polystyrene resin is used. Alternatively, an injection moldable resin, such as a silicone-based rubber or a soft rubber, can be used.

According to the present exemplary embodiment, the cleaning frame member 13 formed of a polystyrene resin and the scooping sheet 11*b* formed of a thin plate member (sheet member) including a polyester resin. Therefore, there is a possibility that the scooping sheet 11*b* is swelled by the difference in thermal expansion due to the difference between the material of the cleaning frame member 13 and the material of the scooping sheet 11*b* when the ambient temperature change occurs. In this case, a gap occurs between the scooping sheet 11*b* and the photosensitive drum 7 on the scooping sheet 11*b* abuts, and the waste toner may be leaked out.

Thus, in the present exemplary embodiment, the fixing portion 31 molded to the frame member can serve as an buffer for absorbing the difference of the cleaning frame member 13 and the scooping sheet 11*b* in linear expansion in an environment left under a high temperature. As a result, the swell of the sheet member after the environment in the high temperature can be prevented.

(Fixing of Scooping Sheet)

A fixing configuration of the scooping sheet 11*b* is described. The scooping sheet 11*b* is fixed to the cleaning frame member 13 via the fixing portion 31. More specifically, the scooping sheet 11*b* is fixed to the cleaning frame member 13 in such a manner that the attaching portion 31*a* of the fixing portion 31 and the connection portion 31*b* are welded together.

(Effect of the Present Exemplary Embodiment)

As described above, according to the present exemplary embodiment, a gap occurring between the scooping sheet fixing surface 13*s* and the scooping sheet 11*b* can be filled by forming the vertical sealing portion 15 and the fixing portion 31 by injection molding of the resin. Further, the gap is eliminated in such a manner that the vertical sealing portion 15 and the fixing portion 31 are melted so as to closely contact with the scooping sheet 11*b*, and toner sealability at an end of the cleaning frame member 13 can be increased. Conventionally, the toner leakage occurs from the gap between the cleaning frame member and the end sealing member of the image bearing member (gap in the thickness direction of the end sealing member of the image bearing member) or the gap between the cleaning frame member and the scooping sheet. Therefore, to solve the problem, conventionally, a process for applying another molten resin is further required for sealing and filling these gaps with a molten resin (hot melt). Thus, the productivity is decreased. In the present exemplary embodiment, however, a hot melt injection process performed for closing the gap between the cleaning frame member 13 and the end sealing 19 is not required, and simplification of a production process can be achieved by the configuration according to the present exemplary embodiment.

In addition, since the sealing member is a soft body component, an automatic machine has difficulty to hold the sealing member. Thus, it becomes difficult to accurately paste the sealing member to the cleaning frame member. In particular, in a process for attaching the sealing member, assembly by the automatic machine is difficult, and the productivity cannot be improved. However, by the configuration according to the present exemplary embodiment, the cartridge configured with the sealing member for which a soft component is not used. Therefore, the assembly is easy and can be performed by the automatic machine whereby has high productivity of the cartridge can be achieved.

(Method for Manufacturing Cleaning Subunit)

The method for forming the cleaning subunit 12 is described.

(Injection Molding Process)

Figure 26:
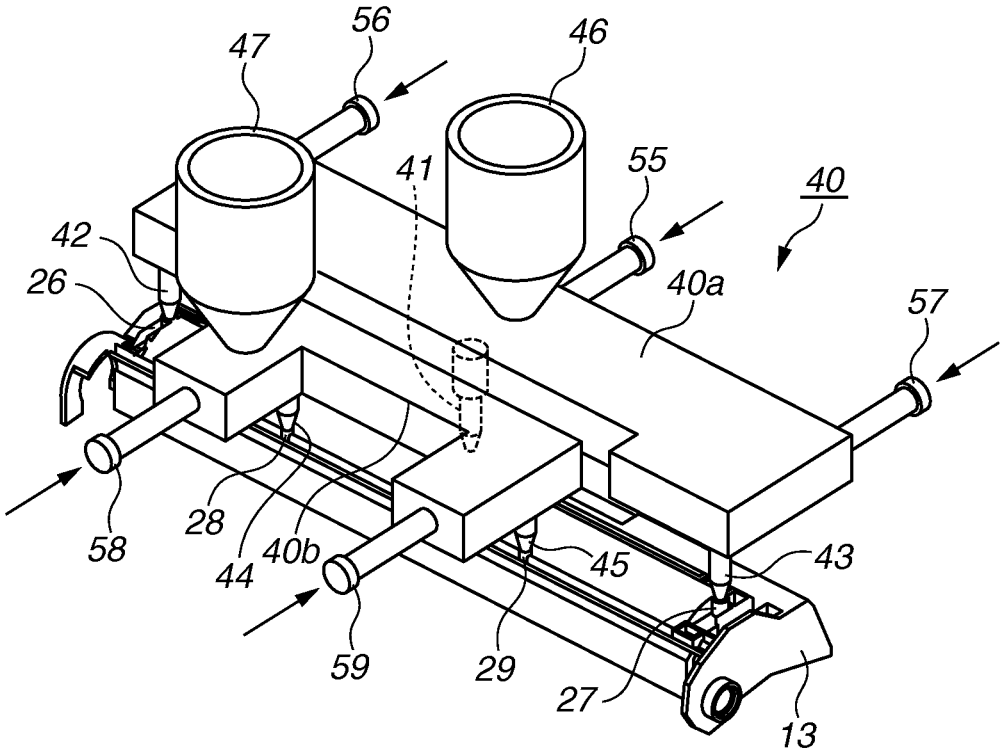
FIG. 26 is a schematic cross sectional view illustrating an injection molding process of resin to a cleaning frame member according to the second exemplary embodiment.
Figure 27A:
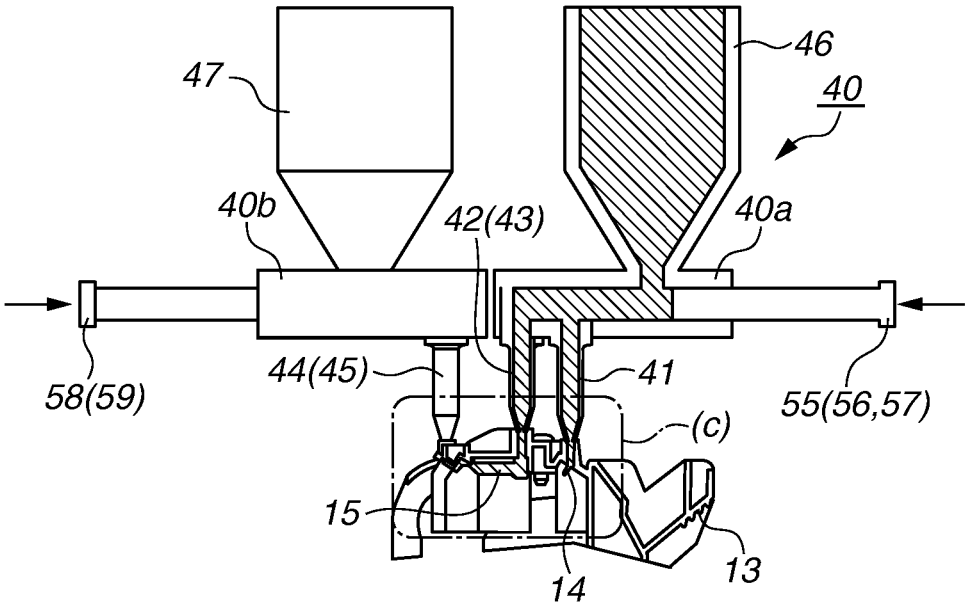
FIGS. 27A and 27B are schematic cross sectional views each illustrating the injection molding process of resin to the cleaning frame member according to the second exemplary embodiment.
Figure 27B:
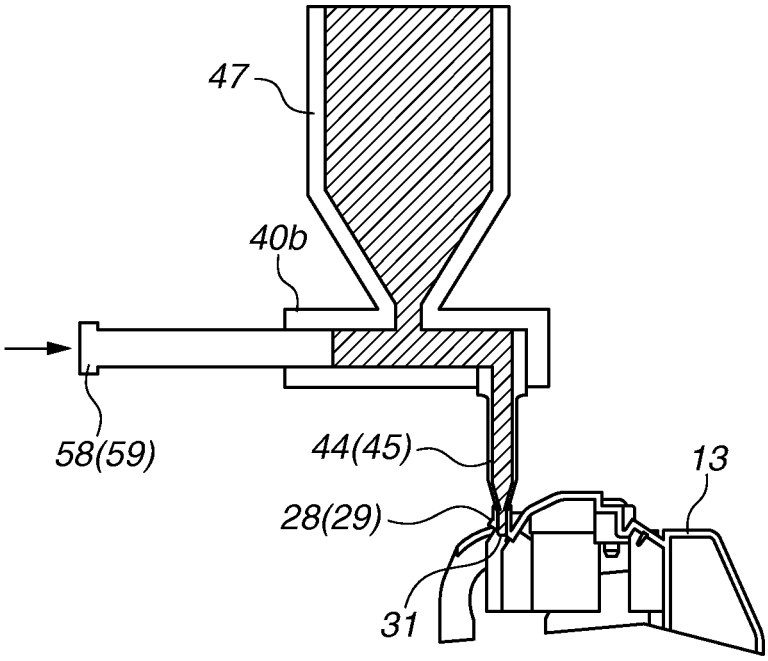
Figure 28A:
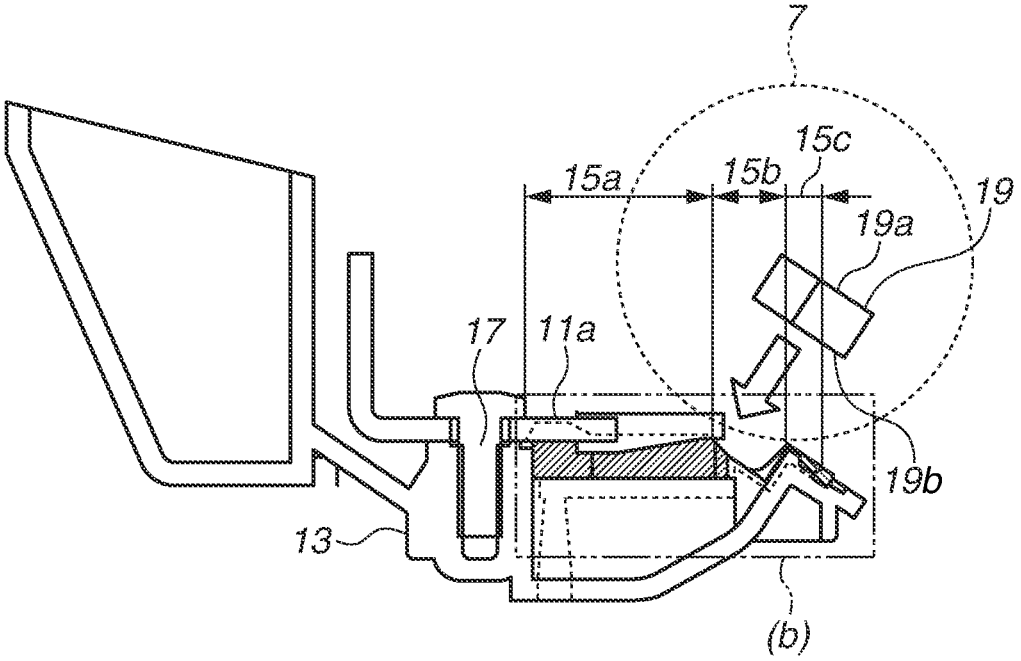
FIGS. 28A and 28B are schematic cross sectional views each illustrating assembly of the photosensitive drum unit according to the second exemplary embodiment.
Figure 28B:
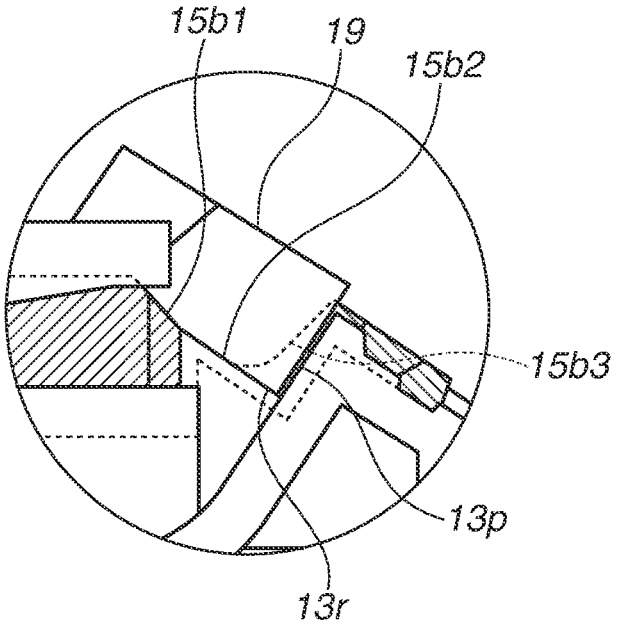

A process for injection molding of the vertical sealing portions 15 and 16 and the fixing portion 31 to the cleaning frame member 13 is described. Although the process according to the present exemplary embodiment is different from the one according to the first exemplary embodiment in that a plurality of resins is injection molded, the process is performed in the same manner as the one according to the first exemplary embodiment. FIG. 26 is a perspective view illustrating the cleaning frame member 13 according to the present exemplary embodiment in a state of being set to a resin injection apparatus. FIGS. 27A and 27B are schematic cross sectional views illustrating the cleaning frame member 13 at the time of injection molding of a resin to the cleaning frame member 13 according to the present exemplary embodiment.

The cleaning frame member 13 to which injection ports 25, 26, 27, 28, and 29 for injecting a molten resin and the vertical sealing portion 15, cleaning blade lower sealing 14, and the groove portions 13*m*, 14*m*, 31*m* for holding the fixing portion 31 are provided is prepared. The injection ports 25, 26, 27, 28, and 29 are provided as holes penetrating the cleaning frame member 13. In the present exemplary embodiment, the injection ports 25, 26, 27, 28, and 29 provided to the cleaning frame member 13 are disposed in such a manner that positions of the injection ports 25, 26, 27, 28, and 29 in the longitudinal direction of the cleaning frame member 13 are shifted from each other.

Vertical sealing molds 51 and 52 for forming the vertical sealing portions 15 and 16 and a scooping sheet mold 53 for forming the fixing portion 31 are fixed to the cleaning frame member 13. As a result, a molten resin can be injected from the injection ports 26 and 27 to the space formed by the vertical sealing molds 51 and 52 and the cleaning frame member 13. In the present exemplary embodiment, the vertical sealing mold 51 (52) is divided into two parts, a mold 51*a* for forming the first portion 15*a* and a mold 51*b* for forming the second portions 15*b* and 15*c*. However, the configuration is not limited to this. Alternatively, the vertical sealing mold 51 in which the mold 51*a* and the mold 51*b* are integrated together may be used.

Similarly, a molten resin is allowed to be injected from the injection ports 28 and 29 to a space formed by the scooping sheet mold 53 and the cleaning frame member 13. In this configuration, the space formed by the scooping sheet mold 53 and the cleaning frame member 13 is made to communicate with the space formed by the vertical sealing molds 51 and 52 and the cleaning frame member 13.

According to the present exemplary embodiment, in addition to the vertical sealing portions 15 and 16 and the fixing portion 31, the cleaning blade lower sealing 14 is also molded in the same process. Therefore, a lower sealing mold 50 for forming the cleaning blade lower sealing 14 is also fixed to the cleaning frame member 13, and a molten resin is allowed to be injected from the injection port 25 to a space formed by the lower sealing mold 50 and the cleaning frame member 13.

Then, as illustrated in FIG. 26, the cleaning frame member 13 is set to the resin injection apparatus 40. The resin injection apparatus 40 includes two resin supplying portions 40*a* and 40*b*, and the hopper portion 46 (40*a*) for supplying the material of the cleaning blade lower sealing 14 and the vertical sealing portions 15 and 16, and a hopper portion 47 (40*b*) for supplying the material of the fixing portion 31. Further, the gates 41 to 45 for injecting a resin are disposed at positions each corresponding to a different one of the injection ports 25 to 29 in the same direction as the injection ports 25 to 29. Further, the injection ports 25 to 29 provided to the cleaning frame member 13 are also disposed in the same direction, so that the gates 41 to 45 can simultaneously abut on the injection ports 25 to 29.

Plungers 55, 56 and 57 of the resin supplying portion 40*a* is driven in directions indicated by the arrows in FIG. 26 in a state that the gates 41, 42 and 43 and the injection ports 25, 26 and 27 respectively abut on each other. Thus, a first elastomer resin that is a sealing material of the cleaning blade lower sealing 14 and the vertical sealing portions 15 and 16 is injected from the gates 41, 42 and 43. Similarly, the plungers 58 and 59 of the resin supplying portion 40*b* is driven in a direction indicated by the arrow illustrated in FIGS. 27A and 27B in a state that the gates 44 and 45 and the injection ports 28 and 29 abut on each other. Thus, a second elastomer resin that is a material of the fixing portion 31 is injected from the gates 44 and 45. The injected first sealing material is poured into a space formed by the cleaning frame member 13, and the lower sealing mold 50 and the vertical sealing molds 51 and 52. Similarly, the injected second sealing material is poured into a space formed by the cleaning frame member 13 and the scooping sheet mold 53.

In this configuration, the first elastomer resin injected from the gates 41, 42 and 43 is made to be poured into a part of the space formed by the cleaning frame member 13 and the scooping sheet mold 53. Start timing, an amount of movement, and a movement speed of the plungers 56 to 59 are adjusted in such a manner that the boundary portion 103 formed by the poured first elastomer resin and the poured second elastomer resin is formed in the third portion 15*c*.

After the completion of injection, the cleaning frame member 13 is removed from the cleaning blade lower sealing mold 50, the vertical sealing molds 51 and 52, and the scooping sheet mold 53 to perform mold release. As a result, the cleaning blade lower sealing 14, the vertical sealing portions 15 and 16, and the fixing portion 31 can be integrally molded with the cleaning frame member 13.

Through the process described above, the cleaning subunit 12 is prepared.

(Cleaning Blade and End Sealing Attachment Process)

The cleaning blade 11*a* is disposed on the cleaning blade lower sealing 14, and is fixed at the blade attachment surfaces 21 and 22 provided to the both ends of the cleaning frame member 13 in the longitudinal direction N with a fixing member 17, such as the screw, to the cleaning frame member 13. In this process, a gap between the cleaning frame member 13 and a plate metal 11*a*2 of the cleaning blade 11*a* is sealed by the cleaning blade lower sealing 14.

Then, as illustrated in FIGS. 27A and 27B, the end sealing 19 is attached to the attaching surface 13*t* of the cleaning frame member 13 so as to abut on the cleaning blade 11*a*, the photosensitive drum 7, and the scooping sheet 11*b* that are attached later. The end sealing 19 is fixed in such a manner that the adhesive surface 19*b* faces to the groove portion 13*m* of the cleaning frame member 13, that is, on the vertical sealing portion 15. In this process, as illustrated FIG. 27B, the end sealing 19 is fixed to the cleaning frame member 13 in such a manner that the vertical sealing portion 15, more specifically the contact portion 15*b*3 protruding from the step portion 13*p* is squashed, and a gap between the end sealing 19 and the cleaning frame member 13 is sealed.

(Scooping Sheet Attaching Process)

An attaching process of the scooping sheet 11*b* is described. In the present exemplary embodiment, a polyester sheet is used for the scooping sheet 11*b*. The scooping sheet 11*b* is disposed at a predetermined position on the fixing portion 31 molded on the cleaning frame member 13. Then, similarly to the first exemplary embodiment (FIG. 17), a heating member 71, such as a heat bar, is pressed on the scooping sheet 11*b*. The heating member 71 is heated at a melting point of the fixing portion 31 or higher and a melting point of the material of the scooping sheet 11*b* or lower. The fixing portion 31 is melted by heat and pressure by the heating member 71, and the cleaning frame member 13 and the scooping sheet 11*b* are attached together. More specifically, not only the attaching portion 31*a* of the fixing portion 31, an entire of the connection portion 31*b* and the third portion 15*c* of the vertical sealing portion 15 is heated. As a result, the connection portion 31*b* is melted and attached to the scooping sheet 11*b*, and a part of the vertical sealing portion 15 in the third portion 15*c* is also melted and closely attached to the scooping sheet 11*b*. Therefore, using a material having compatibility with the material of the scooping sheet 11*b* is desirable for the fixing portion 31.

Further, as a method for melting the fixing portion 31, other than pressing of the heating member 71, the fixing portion 31 may be melted by using a sheet material having a high optical transparency for the scooping sheet 11*b* and performing laser irradiation to the fixing portion 31. In this case, the scooping sheet 11*b* is fixed by a transparent fixing member 72, such as a glass, having a high optical transparency, and the laser irradiation is performed to the attaching portion 31*a* and the connection portion 31*b* by allowing the laser head 73 to scan. Any material that absorbs the laser beam and can be melted may be used for the fixing portion 31. Examples of such material include a resin that is melted by heat and includes a laser reactant, such as carbon, for absorbing light. In the present exemplary embodiment, a styrene-based resin containing 0.5 to 12 parts by mass of carbon is used as the second sealing material used as the fixing portion 31.

After the scooping sheet 11*b* is fixed to the cleaning subunit 12, the photosensitive drum unit 11 is prepared by fixing the photosensitive drum 7 and the charging roller 8 to a predetermined position. Then, the cartridge is prepared by integrating the development unit 10 with the photosensitive drum unit 11.

The injection process is desired to be performed in a state that each of the molds 50 to 53 abuts on the cleaning frame member 13 in such a manner that a resin does not leak out. The injection process may be performed after sequentially allowing the molds 50 to 53 to abut on the cleaning frame member 13, other than allowing the molds 50 to 53 to simultaneously abut on the cleaning frame member 13, which is the case according to the present exemplary embodiment.

(Effect of the Present Exemplary Embodiment)

According to the present exemplary embodiment, other than the effect achieved by the configuration of the cartridge B, the manufactured cartridge B can allow a plurality of components such as the cleaning blade lower sealing 14, the vertical sealing portions 15 and 16, the fixing portion 31 to be manufactured by the resin injection apparatus 40 in the same process. Therefore, the productivity can be increased, and since a process for attaching the sealing member that is a soft body member to the cleaning frame member is not included, the assembly by the automatic machine becomes possible.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application 2014-176313, filed Aug. 29, 2014, and No. 2014-176314, filed Aug. 29, 2014, which are hereby incorporated by reference herein in their entirety.

What is claimed is:

1. A cartridge attachable to and detachable from an image forming apparatus main body, the cartridge comprising:

a cartridge frame;

an image bearing member rotatably provided to the cartridge frame;

an end sealing configured to seal a gap between an end portion of the image bearing member in a rotational axis direction of the image bearing member and the cartridge frame, the end sealing having a fixed surface fixed to the cartridge frame, a contact surface which is opposite to the fixed surface and contacts the end portion of the image bearing member, and a side surface lateral to the fixed surface;

a cleaning unit extending in the rotational axis direction, configured to clean the image bearing member;

a sheet extending in the rotational axis direction, configured to abut on the image bearing member at one end of the sheet in a crossing direction that crosses the rotational axis direction; and a resin member including (i) a fixing part positioned between the sheet and the cartridge frame, configured to fix the other end of the sheet to the cartridge frame and (ii) a sealing part which includes a first portion configured to seal a gap between a longitudinal end portion of the cleaning unit and the cartridge frame, and a second portion configured to seal a gap between the side surface of the end sealing and a surface of the cartridge frame facing the side surface of the end sealing, wherein the resin member is integrally injection molded with the cartridge frame.

2. The cartridge according to claim 1, wherein the fixing part further includes a connection portion, provided at an end portion thereof in the rotational axis direction, extending in the direction crossing the rotational axis direction and is connected to the second portion.

3. The cartridge according to claim 1, wherein the image bearing member is a photosensitive member.

4. The cartridge according to claim 1, wherein the resin member is made of an elastomer.

5. The cartridge according to claim 1, wherein the fixing part of the resin member is made of a resin which absorbs a laser beam and is melted.

6. The cartridge according to claim 1, wherein the sealing part further includes a third portion located between the cartridge frame and the sheet, and wherein a gate for injecting a resin material to a portion of the cartridge frame that does not face the third portion is provided.

7. The cartridge according to claim 1, wherein the cleaning unit is a blade, wherein a blade sealing extending in the rotational axis direction is provided between the blade and the cartridge frame, and wherein the blade sealing and the resin member are integrally injection molded.

8. The cartridge according to claim 7, wherein the blade is fixed to an attachment surface of the cartridge frame with a fixing portion, and wherein a connecting portion is formed along the attachment surface, and the blade sealing and the resin member are integrally formed with the connecting portion.

9. The cartridge according to claim 7, wherein the blade is fixed to an attachment surface of the cartridge frame with a fixing portion, and wherein a connecting portion traversing the attachment surface is formed, and the blade sealing and the resin member are integrally formed with the connecting portion.

10. The cartridge according to claim 1, wherein the second portion of the sealing part of the resin member is configured to seal a gap between a part of the fixed surface of the end sealing and a bottom surface of a groove formed on a surface of the cartridge frame facing the fixed surface of the end sealing.

11. The cartridge according to claim 1, wherein the end sealing and the sheet are arranged so as not to face each other with the sealing part of the resin member therebetween.

12. The cartridge according to claim 1, wherein the second portion of the sealing part of the resin member extends toward the image bearing member along the side surface of the end sealing.

* * * * *